US012287145B2

(12) United States Patent
Xu et al.

(10) Patent No.: US 12,287,145 B2
(45) Date of Patent: Apr. 29, 2025

(54) HEAT EXCHANGER APPARATUS, MANIFOLD ARRANGEMENT FOR A HEAT EXCHANGER APPARATUS, AND METHODS RELATING TO SAME

(71) Applicant: Air Products and Chemicals, Inc., Allentown, PA (US)

(72) Inventors: Fang Xu, Orefield, PA (US); Xukun Luo, Allentown, PA (US); Douglas Paul Dee, Allentown, PA (US); Donn Michael Herron, Fogelsville, PA (US); William T. Kleinberg, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 839 days.

(21) Appl. No.: 16/818,195

(22) Filed: Mar. 13, 2020

(65) Prior Publication Data

US 2021/0285719 A1 Sep. 16, 2021

(51) Int. Cl.
*F25J 1/02* (2006.01)
*F28F 9/26* (2006.01)

(52) U.S. Cl.
CPC ..... *F25J 1/0264* (2013.01); *F28F 9/26* (2013.01)

(58) Field of Classification Search
CPC .... F24F 3/06; F24F 3/08; F25J 1/0264; F28F 9/26; F28D 3/08; F28D 3/082; F25B 29/003
See application file for complete search history.

(56) References Cited

U.S. PATENT DOCUMENTS 3,378,062 A * 4/1968 Ringquist ..... F25B 29/003 62/159
3,603,379 A * 9/1971 Leonard, Jr. ..... F24F 5/0003 165/104.31

(Continued)

FOREIGN PATENT DOCUMENTS

CN 1321868 A 11/2001
CN 101900474 A 12/2010

(Continued)

OTHER PUBLICATIONS

Miller, D.S., Internal Flow Systems, 1978, 5 pgs., BHRA Fluid Engineering, Cranfield, Bedfordshire, UK.

(Continued)

*Primary Examiner* — Jianying C Atkisson
*Assistant Examiner* — For K Ling

(57) ABSTRACT

A heat exchanger apparatus can be configured so that there is at least one "U" or "C" shape configured manifold in combination with at least one "Z" or "S" shape configured manifold for the heat exchanger apparatus for the input and output of fluid into and out of the heat exchangers of the heat exchanger apparatus. In some embodiments, downstream and/or upstream lines can be connected to the manifolds at a center or off-center point for conveying inlet fluid and outlet fluid. A method of retrofitting a pre-existing plant, building a new plant, or designing a new plant that utilizes an embodiment of the heat exchanger apparatus can help provide an improved heat exchanger arrangement without significantly increasing the footprint needed for the arrangement so that a plant can be improved with an embodiment of the apparatus without requiring an enlarged footprint for the plant.

17 Claims, 12 Drawing Sheets

(56) References Cited

U.S. PATENT DOCUMENTS

| | | | | | |
|---|---|---|---|---|---|
| 3,685,574 | A * | 8/1972 | Worms | F24F 3/06 | 165/50 |
| 4,210,957 | A * | 7/1980 | Spethmann | F24F 11/83 | 236/1 EA |
| 4,486,210 | A | 12/1984 | Gauthier | | |
| 4,796,439 | A * | 1/1989 | Yamada | F24F 3/08 | 62/159 |
| 4,843,832 | A * | 7/1989 | Yamada | F24F 3/08 | 165/300 |
| 5,070,704 | A * | 12/1991 | Conry | F24F 11/85 | 62/201 |
| 6,886,629 | B2 | 5/2005 | Dietrich | | |
| 8,141,623 | B2 * | 3/2012 | Blecker | F24F 3/06 | 237/63 |
| 8,397,799 | B2 * | 3/2013 | Blecker | F25B 29/003 | 236/1 C |
| 9,353,958 | B2 * | 5/2016 | Motomura | F25B 47/025 | |
| 9,816,765 | B2 | 11/2017 | Rampp | | |
| 2002/0124596 | A1 | 9/2002 | Corduan et al. | | |
| 2004/0129413 | A1 * | 7/2004 | Yoho, Sr. | F24F 3/08 | 165/218 |
| 2010/0070092 | A1 * | 3/2010 | Winter | F24F 11/0008 | 236/44 C |
| 2010/0186935 | A1 | 7/2010 | Wand | | |
| 2013/0277021 | A1 | 10/2013 | Huebel | | |

FOREIGN PATENT DOCUMENTS

| | | | | |
|---|---|---|---|---|
| CN | 201885515 | | 6/2011 | |
| CN | 102439380 | A | 5/2012 | |
| DE | 1778032 | A1 * | 7/1971 | F24F 11/81 |
| EP | 24420526 | A2 | 4/2012 | |
| WO | 2018206886 | A1 | 11/2018 | |
| WO | 2019110655 | A1 | 6/2021 | |

OTHER PUBLICATIONS

Fisher, B. et al; "A New LNG Process is now Available"; GPA Technical Meeting, Feb. 1, 2002, pp. 1-11.

Translation of 08191CN FER and Search Report for Corrsponding CN Application No. CN20110271507; Received Oct. 28, 2022.

* cited by examiner

HEAT EXCHANGER APPARATUS, MANIFOLD ARRANGEMENT FOR A HEAT EXCHANGER APPARATUS, AND METHODS RELATING TO SAME

FIELD

The present innovation relates to manifolds for heat exchangers, heat exchangers, plants having a heat exchanger apparatus that includes manifolds and a plurality of heat exchangers, and methods of making and using the same.

BACKGROUND

Heat exchanges are often used in different types of plants. For instance, air separation plants often include one or more "cold boxes" that are usually built with steel frames and filled with insulating materials. Depending on the plant size, one or more parallel heat exchangers can be installed in a single "cold box. Manifolds are typically used to distribute fluid into multiple heat exchanges and also collect the fluid output from the heat exchangers.

A flow imbalance between parallel cores of heat exchanges can reduce heat transfer efficiency of the "cold box" and increase the power usage of the plant. To ensure a good flow distribution in the multiple heat exchangers of the "cold box", the pressure drop that takes place in the inlet manifold and outlet manifold for each heat exchanger typically needs to be balanced. The pressure drop in the manifolds depends on the length of manifolds, the diameter of manifolds, mass flow rate, and the flow physical properties, such as density, viscosity.

We have determined that manifold layouts for an array of heat exchangers are often complicated because multiple hot and cold streams are present. The complicated manifold layout can directly restrict the plant layout, which could be a big factor of the total cost for building a plant or installing a "cold box." In particular, manifolds often require use of a lot of space and can require a significant portion of a footprint of the plaint's overall layout. This footprint can be significant in terms of surface area as well as overall volume of a particular plant layout.

It is our understanding that the common practice in the art is to use the same type of manifolds for all inlet and outlet streams for the heat exchangers of an array of heat exchangers (e.g. heat exchangers of a "cold box"). This may be done to help ensure that the manifold design is as simple as possible to help ensure a relatively straightforward fabrication of the design so that a manifold installed in a plant is able to provide a good flow distribution to multiple heat exchangers. This approach may also help reduce the complexity of the design calculations needed to ensure the designed and fabricated manifold avoids significant flow imbalances and provides a good flow distribution when installed in a plant.

It is our understanding that another common practice is to connect the inlet or outlet manifolds from the terminal ends of manifolds with upstream or downstream lines. This may be necessary due to the user of the same manifold designs. We have determined that this approach can restrict the plant layout. It can also require extra piping to connect the streams with other apparatuses.

SUMMARY

We have determined that common practices for installation and retrofitting of heat exchanger arrangements in plants that we are aware of have significant drawbacks. For instance, the use of a common manifold design and the use of inlet and outlet manifolds being connected at their terminal ends to upstream or downstream lines can require a cold box in which the manifolds are positioned to be much larger than necessary. This can add to the cost of fabrication for a plant or the retrofitting of a plant to upgrade the plant's heat exchanger arrangement. Further, it can limit options for retrofitting a plant that may take advantage of new heat exchanger designs or heat exchanger technologies by requiring more space than what is available in the plant for the retrofitting of the plant to occur. We have determined that a new manifold arrangement and heat exchanger apparatus is needed to help address such issues to provide an improvement in plant design flexibility and plant retrofitting flexibility while also helping to reduce the costs associated with fabrication and installation.

We also determined that flow maldistribution in multiple heat exchangers can be caused by the pressure drop in the manifolds. To evenly distribute the flow in multiple heat exchangers, one practice was to minimize the pressure drop in the manifolds by using large size manifolds. However, we have determined that the manifold size directly affects the cold box dimensions and the cost. In contrast to this approach, embodiments of our method and apparatus can reduce the manifold size while achieving even flow distribution for an array of multiple heat exchangers.

A heat exchanger apparatus is provided. The heat exchanger apparatus can be designed to be included in a plant in some embodiments. Some embodiments of the heat exchanger apparatus can include a first fluid inlet manifold connectable to at least one input stream to receive a first fluid at a first fluid inlet of the first fluid inlet manifold, the first fluid having a first temperature and a second fluid inlet manifold connectable to at least one input stream to receive a second fluid at a second fluid inlet of the second fluid inlet manifold. The second fluid can have a second temperature that is below the first temperature or above the first temperature. The apparatus can also include a second fluid outlet manifold and a first fluid outlet manifold. A plurality of heat exchangers can also be included. Each of the heat exchangers can be connected to the first fluid inlet manifold, the first fluid outlet manifold, the second fluid inlet manifold, and the second fluid outlet manifold so that the first fluid and the second fluid are passable through the heat exchangers so that heat is transferred between the first fluid and the second fluid so that the first fluid changes in enthalpy and the second fluid changes in enthalpy as the first fluid and the second fluid pass through the heat exchangers. The first fluid outlet manifold can be connectable to at least one first output stream to output the first fluid after the first fluid has had a change in enthalpy via the plurality of heat exchangers and the second fluid outlet manifold can be connectable to at least one second output stream to output the second fluid after the second fluid has had a change in enthalpy via the plurality of heat exchangers.

It should be appreciated that a change in enthalpy can result in a temperature change of a fluid and/or a change in a phase of a fluid (e.g. the fluid transitioning from a gas to a liquid or the fluid transitioning from a liquid to a gas, etc.).

Embodiments of the heat exchanger apparatus can also be configured so that at least one of the following features are provided:

(a) the first fluid inlet manifold and the first fluid outlet manifold are configured so that the first fluid passes between the first fluid inlet manifold and the first fluid outlet manifold and also through the heat exchangers in a Z-shaped flow pattern or an S-shaped flow pattern and the second fluid inlet manifold and the second fluid outlet manifold are configured so that the second fluid passes between the second fluid inlet manifold and the second fluid outlet manifold and also through the heat exchangers in a C-shaped flow pattern or a U-shaped flow pattern;

(b) the first fluid inlet manifold and the first fluid outlet manifold are configured so that a first portion of the first fluid passes between the first fluid inlet manifold and the first fluid outlet manifold and also through the heat exchangers in a Z-shaped flow pattern or an S-shaped flow pattern and a second portion of the first fluid passes between the first fluid inlet manifold and the first fluid outlet manifold and also through the heat exchangers in a U-shaped flow pattern or a C-shaped flow pattern;

(c) the second fluid inlet manifold and the second fluid outlet manifold are configured so that a first portion of the second fluid passes between the second fluid inlet manifold and the second fluid outlet manifold and also through the heat exchangers in a Z-shaped flow pattern or an S-shaped flow pattern and a second portion of the second fluid passes between the second fluid inlet manifold and the second fluid outlet manifold and also through the heat exchangers in a U-shaped flow pattern or a C-shaped flow pattern;

(d) the first fluid inlet manifold and the first fluid outlet manifold are configured so that a first portion of the first fluid passes between the first fluid inlet manifold and the first fluid outlet manifold and also through the heat exchangers in a U-shaped flow pattern or a C-shaped flow pattern and a second portion of the first fluid passes between the first fluid inlet manifold and the first fluid outlet manifold and also through the heat exchangers in a U-shaped flow pattern or a C-shaped flow pattern; and/or (e) the second fluid inlet manifold and the second fluid outlet manifold are configured so that a first portion of the second fluid passes between the second fluid inlet manifold and the second fluid outlet manifold and also through the heat exchangers in a U-shaped flow pattern or a C-shaped flow pattern and a second portion of the second fluid passes between the second fluid inlet manifold and the second fluid outlet manifold and also through the heat exchangers in a U-shaped flow pattern or a C-shaped flow pattern.

For example, the first fluid inlet manifold and the first fluid outlet manifold can be configured so that the first fluid passes between the first fluid inlet manifold and the first fluid outlet manifold and also through the heat exchangers in a Z-shaped flow pattern or an S-shaped flow pattern and the second fluid inlet manifold and the second fluid outlet manifold are configured so that the second fluid passes between the second fluid inlet manifold and the second fluid outlet manifold and also through the heat exchangers in a C-shaped flow pattern or a U-shaped flow pattern. As another example, the first fluid inlet manifold and the first fluid outlet manifold can be configured so that the first portion of the first fluid passes between the first fluid inlet manifold and the first fluid outlet manifold and also through the heat exchangers in a Z-shaped flow pattern or an S-shaped flow pattern and the second portion of the first fluid passes between the first fluid inlet manifold and the first fluid outlet manifold and also through the heat exchangers in a U-shaped flow pattern or a C-shaped flow pattern.

As another example, the second fluid inlet manifold and the second fluid outlet manifold can be configured so that the first portion of the second fluid passes between the second fluid inlet manifold and the second fluid outlet manifold and also through the heat exchangers in a Z-shaped flow pattern or an S-shaped flow pattern and the second portion of the second fluid passes between the second fluid inlet manifold and the second fluid outlet manifold and also through the heat exchangers in a U-shaped flow pattern or a C-shaped flow pattern. Additionally, the first fluid inlet manifold and the first fluid outlet manifold can be configured so that the first portion of the first fluid passes between the first fluid inlet manifold and the first fluid outlet manifold and also through the heat exchangers in a Z-shaped flow pattern or an S-shaped flow pattern and the second portion of the first fluid passes between the first fluid inlet manifold and the first fluid outlet manifold and also through the heat exchangers in a U-shaped flow pattern or a C-shaped flow pattern.

Embodiments of the heat exchanger apparatus can be configured to provide flexibility for where fluid inlets and/or outlets can be located. For instance, the first fluid inlet can be positioned at a central portion of the heat exchanger apparatus between the left side and right side of the heat exchanger apparatus or the first fluid inlet can be positioned at a left side of the heat exchanger apparatus or a right side of the heat exchanger apparatus. Additionally, the second fluid inlet can be positioned at a central portion of the heat exchanger apparatus located between a left side of the heat exchanger apparatus and a right side of the heat exchanger apparatus or the second fluid inlet can be positioned at a right side or a left side of the heat exchanger apparatus.

Embodiments of the heat exchanger apparatus can also be configured so that the first fluid outlet manifold has a first fluid outlet that is connectable to the at least one first output stream. The first fluid outlet can be positioned at a right side or a left side of the heat exchanger apparatus or can be positioned at a central position of the heat exchanger apparatus between a left side of the heat exchanger apparatus and a right side of the heat exchanger apparatus.

Embodiments of the heat exchange apparatus can also be configured so that the second fluid outlet manifold has a second fluid outlet that is connectable to the at least one second output stream. The second fluid outlet can be positioned at a right side or a left side of the heat exchanger apparatus or the second fluid outlet can be positioned at a central position of the heat exchanger apparatus between a left side of the heat exchanger apparatus and a right side of the heat exchanger apparatus.

A method of operating a heat exchanger apparatus within a plant is also provided. The method can include operating an embodiment of the heat exchanger apparatus so that:

(a) the first fluid passes between the first fluid inlet manifold and the first fluid outlet manifold and also through the heat exchangers in a Z-shaped flow pattern or an S-shaped flow pattern and the second fluid passes between the second fluid inlet manifold and the second fluid outlet manifold and also through the heat exchangers in a C-shaped flow pattern or a U-shaped flow pattern;

(b) the first portion of the first fluid passes between the first fluid inlet manifold and the first fluid outlet manifold and also through the heat exchangers in a Z-shaped flow pattern or an S-shaped flow pattern and the second portion of the first fluid passes between the first fluid inlet manifold and the first fluid outlet manifold and also through the heat exchangers in a U-shaped flow pattern or a C-shaped flow pattern;

(c) the first portion of the second fluid passes between the second fluid inlet manifold and the second fluid outlet manifold and also through the heat exchangers in a Z-shaped flow pattern or an S-shaped flow pattern and the second portion of the second fluid passes between the second fluid inlet manifold and the second fluid outlet manifold and also through the heat exchangers in a U-shaped flow pattern or a C-shaped flow pattern;

(d) the first portion of the first fluid passes between the first fluid inlet manifold and the first fluid outlet manifold and also through the heat exchangers in a U-shaped flow pattern or a C-shaped flow pattern and the second portion of the first fluid passes between the first fluid inlet manifold and the first fluid outlet manifold and also through the heat exchangers in a U-shaped flow pattern or a C-shaped flow pattern; and/or (e) the first portion of the second fluid passes between the second fluid inlet manifold and the second fluid outlet manifold and also through the heat exchangers in a U-shaped flow pattern or a C-shaped flow pattern and the second portion of the second fluid passes between the second fluid inlet manifold and the second fluid outlet manifold and also through the heat exchangers in a U-shaped flow pattern or a C-shaped flow pattern.

A method of providing a heat exchanger apparatus for a plant is also provided. Embodiments of the method can include sizing a first fluid inlet manifold and a first fluid outlet manifold so that a pressure gain in the first fluid inlet manifold is balanced by a pressure drop in the first fluid outlet manifold to minimize flow maldistribution of a first fluid as the first fluid is passed from the first fluid inlet manifold to the first fluid outlet manifold such that different portions of the first fluid are passed through different heat exchangers of the heat exchanger apparatus as the first fluid is passed from the first fluid inlet manifold to the first fluid outlet manifold. Embodiments of the method can also (or alternatively) include sizing a second fluid inlet manifold and a second fluid outlet manifold so that a pressure gain in the second fluid inlet manifold is balanced by a pressure drop in the second fluid outlet manifold to minimize flow maldistribution of a second fluid as the second fluid is passed from the second fluid inlet manifold to the second fluid outlet manifold such that different portions of the second fluid are passed through different heat exchangers of the heat exchanger apparatus as the second fluid is passed from the second fluid inlet manifold to the second fluid outlet manifold.

Other details, objects, and advantages of the manifolds for heat exchangers, heat exchangers, plants having a heat exchanger apparatus that includes manifolds and a plurality of heat exchangers, and methods of making and using the same will become apparent as the following description of certain exemplary embodiments thereof proceeds.

BRIEF DESCRIPTION OF THE DRAWINGS

Exemplary embodiments of manifolds for heat exchangers, heat exchangers, plants having a heat exchanger apparatus that includes manifolds and a plurality of heat exchangers, and methods of making and using the same are shown in the drawings included herewith. It should be understood that like reference characters used in the drawings may identify like components.

DETAILED DESCRIPTION OF EXEMPLARY EMBODIMENTS

Figure 1:
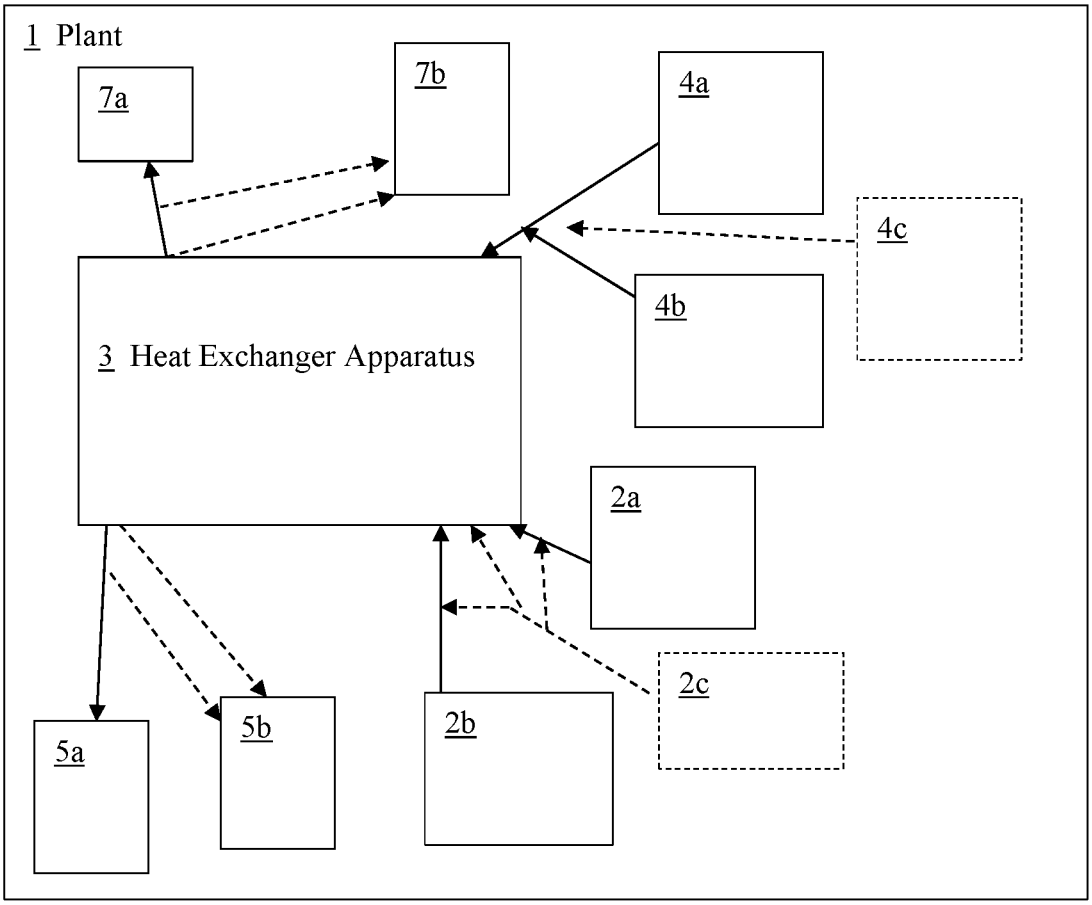
FIG. 1 is a block diagram of an exemplary plant that can include a heat exchanger apparatus.

Referring to FIGS. 1-12, a plant 1 can be configured to include one or more units that can create one or more streams of heated fluid (e.g. heated gas, heated liquid, etc.) and use the heat from such fluid in heat transfer operations to efficiently use heat and energy in plant operations. The plant 1 can include a heat exchanger apparatus 3 that receives:

(a) heated fluid from one or more plant units that is to be cooled via one or more heat exchangers 11 of the heat exchanger apparatus 3; and (b) cooler fluid from one or more other plant units that is to be heated via the heat exchanger apparatus 3.

The heat exchanger apparatus 3 can be positioned in the plant 1 to help improve the thermal and energy efficiency of the plant operations. For example, the heat exchanger apparatus 3 can cool the received heated fluid by using the heat from this heated fluid to heat the cooler fluid it receives from one or more plant units so that the cooled fluid can be utilized in one or more other plant processes after it is heated and the heated fluid can also be utilized in one or more other plant processes after it is cooled. The heat exchangers 11 of the heat exchanger apparatus 3 can be configured so that the heated fluid flows in a direction that is countercurrent or co-current to the flow direction of the cooler fluid to be heated via the heated fluid (while also cooling the hotter fluid via the heat transfer). In embodiments where multiple heat exchangers 11 are present in the heat exchanger apparatus, each heat exchanger 11 can have the same counter-current flow arrangement or co-current flow arrangement. It is also contemplated that alternative embodiments could be configured so that some heat exchangers operate with a counter-current arrangement while others operate with a co-current flow arrangement.

Each heat exchanger 11 can be configured for receiving one or more input streams of warmer fluid and one or more input streams of cooler fluid for transport of heat from the warmer fluid(s) to the cooler fluid(s). For instance, each heat exchanger 11 can receive at least one input stream of warmer fluid and also receive multiple input streams of cooler fluid from different cooler fluid manifolds. As another example, each heat exchanger 11 can receive input streams of warmer fluid from multiple warmer fluid manifolds and also receive multiple input streams of cooler fluid from different cooler fluid manifolds.

Examples of heat exchanger arrangements and heat exchanger apparatuses as well as methods of providing and operating the same can be appreciated from FIGS. 1-12. For example, a plant 1 can be configured as an air separation plant that includes a distillation column 2*a* and a reactor 2*b*. In some embodiments, the plant can also include at least one other process unit 2*c* (indicated via broken line in FIG. 1) that can be configured to generate at least one heated output stream during operation. Flows of heated fluid from the distillation column 2*a*, reactor 2*b*, and/or at least one other process unit 2*c* can be fed to the heat exchanger apparatus 3 as heated fluid input(s). The at least one other process unit 2*c* can be, for example, a purification unit, wash unit, absorber unit, filter unit, or adsorber unit, or other type of process unit of the plant 1.

In some embodiments, the heated fluid fed to the heat exchanger apparatus 3 can be a first fluid that is the same or substantially the same type of fluid (e.g. the fluid has the same composition or is substantially the same type of composition, e.g. nitrogen gas ($N_2$) that has a temperature within a first heated fluid range, an oxygen gas ($O_2$) that has a temperature within a first heated fluid range, a mixture of nitrogen ($N_2$), oxygen ($O_2$), and carbon dioxide ($CO_2$) gases within the first heated fluid temperature range, purified air comprised of $N_2$, $O_2$, with relatively low or trace amounts of other gases within the first heated fluid temperature range, etc.). The first fluid can be a heated gas. In some embodiments, it is possible the first fluid may be a heated liquid or a combination of heated liquid and gas. It is also contemplated that the first fluid can include particulates entrained within a fluid (e.g. a type of slurry).

A temperature range for the first fluid can be in the range of −50° C. to 50° C. for some embodiments. A pressure range for the first fluid that is to enter the heat exchanger apparatus 3 can be 0.5 bar to 135 bar or 50 kPa to 13,500 kPa in some embodiments.

The plant 1 can also include one or more other units for supplying a second fluid to the heat exchanger apparatus 3. The second fluid can be colder fluid that is cooler than the temperature of the first fluid so that the second fluid can be heated via the heated first fluid received by the heat exchanger apparatus 3. The heat exchanger apparatus 3 can receive the second fluid from a distillation column 4*a*, a reactor 4*b*, and/or other plant unit 4*c* (indicated via broken line in FIG. 1) arranged to provide the second fluid to the heat exchanger apparatus 3. In some embodiments, the second fluid fed to the heat exchanger apparatus 3 can have a particular composition or be substantially the same type of fluid (e.g. the fluid has the same composition or is substantially the same type of composition, e.g. nitrogen gas ($N_2$) that has a temperature within a second cooler fluid range, an oxygen gas ($O_2$) that has a temperature within a second heated fluid range, a mixture of nitrogen ($N_2$) with at least oxygen ($O_2$), and carbon dioxide ($CO_2$) gases within the second cooler fluid temperature range, purified air comprised of $N_2$, $O_x$, with relatively low or trace amounts of other gases, etc.). For instance, the second fluid fed to the heat exchanges for being heated can be a non-pure nitrogen gas having other constituent elements that is output from a distillation column 4*a* for being heated via the heat exchanger apparatus 3.

The second fluid can be a gas, a liquid, or a combination of gas and liquid. In some embodiments, it is possible solid particulates can also be included in the second fluid (e.g. the fluid is a type of slurry). In some embodiments, the temperature range for the second fluid can be in the range of −200° C. to −100° C. The pressure range for the second fluid that is to enter the heat exchanger apparatus 3 can be 0.5 bar to 135 bar or 50 kPa to 13,500 kPa in some embodiments.

After the second fluid is heated in the heat exchanger apparatus 3, it can be output for use in at least one other plant processing unit. For example, the second fluid can be output from the heat exchanger apparatus to be fed to an adsorption bed of an adsorber 5*a* or reactor. The second fluid can be alternatively (or also) fed from the heat exchanger apparatus 3 to another plant unit 5*b* for heating or cooling that unit or for undergoing additional treatment (e.g. a reaction via a reactor, a purification process via a washer, filter, or absorber, etc.) as indicated in broken line in FIG. 1.

After the first fluid is cooled in the heat exchanger apparatus 3, it can be output for use in at least one other plant processing unit. For example, the first fluid can be output from the heat exchanger apparatus 3 to be fed to a distillation column 7*a* and/or other plant processing unit 7*b* (e.g. a reactor, a purification process unit such as a washer, filter, absorber, etc.) as indicated via broken line in FIG. 1.

In yet other embodiments of the plant 1, the first fluid, after it is cooled, can be fed to a process unit that supplied second fluid to the heat exchanger apparatus 3 or can be recycled back to a process unit that supplied the first fluid to the heat exchanger to be cooled. Additionally, the second fluid, after it is heated, can be fed to a process unit that supplied first fluid to the heat exchanger apparatus 3 or can be recycled back to a process unit that supplied the second fluid to the heat exchanger apparatus 3 to be heated.

In some embodiments, the heat exchanger apparatus 3 can be positioned in the plant to only receive a first fluid from a single process unit, such as the distillation column 2*a*, reactor 2*b* or other process unit 2*c* (e.g. air purifier). The heat exchanger apparatus 3 can also be positioned in the plant to only receive a second fluid from a single process unit, such as the distillation column 4*a*, reactor 4*b*, or other plant unit 4*c* (e.g. adsorber, absorber, purification unit, etc.).

In some embodiments of the plant 1, there may be multiple similar units that operate in parallel (e.g. multiple distillation columns 4*a* and/or distillation columns 2*a* etc.). Each such unit may feed the same or substantially same fluid to the heat exchanger apparatus 3. For embodiments in which only a single first fluid is fed to the heat exchanger apparatus 1, that first fluid may be received from these same units outputting the same first fluid or substantially the same first fluid in parallel. The heat exchanger apparatus 3 can receive such first fluid flows from multiple different inlet streams or from a mixer device that may mix the similar fluid flows before that fluid is then fed to the heat exchanger apparatus. Similarly, for embodiments in which only a single second fluid is fed to the heat exchanger apparatus 1, that second fluid may be received from these same units outputting the same second fluid or substantially same second fluid in parallel. The heat exchanger apparatus 3 can receive such second fluid flows from multiple different inlet streams or from a mixer device that may mix the similar fluid flows before that fluid is fed to the heat exchanger apparatus.

In other embodiments, the cooler fluid fed to the heat exchanger apparatus 3 can be a first fluid that is the same or substantially the same type of fluid (e.g. the fluid has the same composition or is substantially the same type of composition, e.g. nitrogen gas ($N_2$) that has a temperature within a first cooler fluid range, an oxygen gas ($O_2$) that has a temperature within a first cooler fluid temperature range, a mixture of nitrogen ($N_2$), oxygen ($O_2$), and carbon dioxide ($CO_2$) gases within the first cooler fluid temperature range, purified air comprised of $N_2$, $O_2$, with relatively low or trace amounts of other gases within the first cooler fluid temperature range, etc. For such embodiments, the first fluid can be a gas, a liquid, or a combination of gas and liquid. In some embodiments, it is possible solid particulates can also be included in the first fluid (e.g. the fluid is a type of slurry). In some embodiments, the temperature range for the first cooler fluid can be in the range of −200° C. to −100° C. The pressure range for the first fluid that is to enter the heat exchanger apparatus 3 can be 0.5 bar to 135 bar or 50 kPa to 13,500 kPa in some embodiments where the first fluid is the cooler fluid to be heated by the second fluid via heat exchangers 11.

For embodiments where the first fluid is the cooler fluid, the second fluid can be a heated fluid that is hotter than the temperature of the first fluid so that the second fluid can be cooled by heating the cooler first fluid received by the heat exchanger apparatus 3. In some embodiments, the second fluid fed to the heat exchanger apparatus 3 can have a particular composition or be substantially the same type of fluid (e.g. the fluid has the same composition or is substantially the same type of composition, e.g. nitrogen gas ($N_2$) that has a temperature within a second heated fluid temperature range, an oxygen gas ($O_2$) that has a temperature within a second heated fluid temperature range, a mixture of nitrogen ($N_2$) with at least oxygen ($O_2$), and carbon dioxide ($CO_2$) gases within the second heated fluid temperature range, purified air comprised of $N_2$, $O_x$, with relatively low or trace amounts of other gases, etc.). A temperature range for the second fluid can be in the range of −50° C. to 50° C. for some embodiments in which the second fluid is hotter than the first fluid. A pressure range for the second fluid that is to enter the heat exchanger apparatus 3 can be 0.5 bar to 135 bar or 50 kPa to 13,500 kPa in some embodiments.

For embodiments where the first fluid is the cooler fluid, the first fluid can be output for use in at least one other plant processing unit after it is heated in the heat exchanger apparatus 3. For example, the first fluid can be output from the heat exchanger apparatus to be fed to an adsorption bed of an adsorber 5*a* or reactor. The first fluid can be alternatively (or also) fed from the heat exchanger apparatus 3 to another plant unit 5*b* for heating or cooling that unit or for undergoing additional treatment (e.g. a reaction via a reactor, a purification process via a washer, filter, or absorber, etc.) as indicated in broken line in FIG. 1.

After the second fluid is cooled in the heat exchanger apparatus 3, it can be output for use in at least one other plant processing unit. For example, the second fluid can be output from the heat exchanger apparatus 3 to be fed to a distillation column 7*a* and/or other plant processing unit 7*b* (e.g. a reactor, a purification process unit such as a washer, filter, absorber, etc.) as indicated via broken line in FIG. 1.

In yet other embodiments of the plant 1 where the second fluid is the hotter fluid fed to the heat exchanger apparatus 3, the second fluid, after it is cooled, can be fed to a process unit that supplied first fluid to the heat exchanger apparatus 3 or can be recycled back to a process unit that supplied the second fluid to the heat exchanger to be cooled. Additionally, the first fluid, after it is heated, can be fed to a process unit that supplied second fluid to the heat exchanger apparatus 3 or can be recycled back to a process unit that supplied the first fluid to the heat exchanger apparatus 3 to be heated.

In some embodiments, the heat exchanger apparatus 3 can be positioned in the plant to only receive a heated second fluid from a single process unit, such as the distillation column 2*a*, reactor 2*b* or other process unit 2*c* (e.g. air purifier). The heat exchanger apparatus 3 can also be positioned in the plant to only receive a cooler first fluid from a single process unit, such as the distillation column 4*a*, reactor 4*b*, or other plant unit 4*c* (e.g. adsorber, absorber, purification unit, etc.).

In some embodiments of the plant 1, there may be multiple similar units that operate in parallel (e.g. multiple distillation columns 4*a* and/or distillation columns 2*a* etc.). Each such unit may feed the same or substantially same fluid to the heat exchanger apparatus 3. For embodiments in which only a single first fluid is fed to the heat exchanger apparatus 1, that first fluid may be received from these same units outputting the same first fluid or substantially the same first fluid in parallel. The heat exchanger apparatus 3 can receive such first fluid flows from multiple different inlet streams or from a mixer device that may mix the similar fluid flows before that fluid is then fed to the heat exchanger apparatus. Similarly, for embodiments in which only a single second fluid is fed to the heat exchanger apparatus 1, that second fluid may be received from these same units outputting the same second fluid or substantially same second fluid in parallel. The heat exchanger apparatus 3 can receive such second fluid flows from multiple different inlet streams or from a mixer device that may mix the similar fluid flows before that fluid is fed to the heat exchanger apparatus.

The heat exchanger apparatus 3 of the plant 1 can be configured to help minimize the footprint of the heat exchanger apparatus 3 or to allow the heat exchanger apparatus 3 to be retrofitted into a pre-existing plant 1. FIGS. 2-12 illustrate examples of the heat exchanger apparatus 3 that can be included in the plant 1.

Each heat exchanger apparatus 3 can include a first fluid inlet manifold 12 that has a first fluid inlet 12*a* that receives first fluid (e.g. heated fluid at a temperature that is greater than a temperature of the second fluid or cooler fluid that is at a temperature that is less than the temperature of the second fluid) from one or more plant process units via at least one first fluid inlet stream (e.g. at least one conduit through which the first fluid flows from a plant process unit to the first fluid inlet 12*a*). The heat exchanger apparatus 3 also include a first fluid outlet manifold 15 that has a first fluid outlet 15*a* for outputting the first fluid after it has been passed through heat exchangers 11 for (i) transferring heat to a cooler second fluid so it is thereby cooled or (ii) receiving heat from the hotter second fluid so it is thereby heated.

For instance, the first fluid outlet 15*a* of the first fluid outlet manifold can be connected to at least one first fluid outlet stream (e.g. at least one conduit through which the first fluid flows from the first fluid outlet 15*a* to a plant process unit that may utilize the cooled first fluid or heated first fluid).

The heat exchanger apparatus also has a second fluid inlet manifold 14 that has a second fluid inlet 14*a* for receiving the second fluid from one or more plant units and a second fluid outlet manifold 13 that has a second fluid outlet 13*a* for outputting the second fluid after it has been heated via being passed through the heat exchangers 11 to receive heat from the hotter first fluid. The second fluid inlet 14*a* can be connected to at least one second fluid inlet stream (e.g. at least one conduit through which the second fluid flows from a plant process unit to the second fluid inlet 14*a*). The second fluid outlet 13*a* can be connected to at least one second fluid outlet stream (e.g. at least one conduit through which the second fluid flows from the second fluid outlet 13*a* to at least one plant process unit after a transfer of heat has occurred via the second fluid and first fluid passing through the heat exchangers 11).

The heat exchanger apparatus 3 can include a plurality of heat exchangers 11. For instance, the apparatus can include a first heat exchanger 11*a*, a second heat exchanger 11*b*, a third heat exchanger 11*c*, a fourth heat exchanger 11*d*, and a fifth heat exchanger 11*e*. The heat exchanger apparatus 3 can include more than five heat exchangers or less than five heat exchangers. Each heat exchanger 11 can have a similar core structure to facilitate heat transfer between flows of fluid (e.g. configured for countercurrent flow or parallel flows). Alternatively, the heat exchangers 11 can be configured to utilize a different core structure to facilitate heat transfer.

Each heat exchanger 11 of the heat exchanger apparatus 3 has a first fluid inlet 18 that receives the first fluid from the first fluid inlet manifold 12 and a first fluid outlet 19 that outputs the first fluid from the heat exchanger 11 for being fed to the first fluid outlet manifold 15. Each heat exchanger 11 also has a second fluid inlet 17 for receiving second fluid from the second fluid inlet manifold 14 and a second fluid outlet 16 for outputting the second fluid to the second fluid outlet manifold 13. In operation, it should be appreciated that either:

(i) the second fluid can be hotter at the second fluid outlet 16 as compared to its temperature at the second fluid inlet 17 and the first fluid can be cooler at the first fluid outlet 19 as compared to its temperature at the first fluid inlet 18 for embodiments where the first fluid is hotter than the second fluid and is cooled when passed through the heat exchangers 11 to heat the second fluid; or (ii) the first fluid can be hotter at the first fluid outlet 19 as compared to its temperature at the first fluid inlet 18 and the second fluid can be cooler at the second fluid outlet 16 as compared to its temperature at the first fluid inlet 17 for embodiments where the first fluid is heated in the heat exchangers 11 via the hotter second fluid.

In some embodiments, the transfer of heat that occurs in operation may change the enthalpy of the fluids passed through the heat exchanger 11, but may not change the temperature of a fluid. For instance, in some embodiments it is contemplated that a cooler liquid flow that is at or near its liquid-to-gas transition temperature can be passed into the heat exchanger 11 and be heated such that the liquid flow changes its phase from liquid to gas but does not significantly change in temperature. As another example, in some embodiments it is contemplated that a warmer gas flow that is at or near its liquid-to-gas transition temperature can be passed into the heat exchanger 11 and be cooled via transferring its heat to a cooler fluid such that the gas flow changes its phase from gas to liquid but does not significantly change in temperature.

As discussed above, the change in enthalpy (e.g. a change in temperature and/or phase) that can occur is due to the heat transfer that occurs within the heat exchanger 11. This heat transfer occurs as the hotter fluid is passed through one or more conduits of the heat exchanger 11 next to one or more conduits in which the cooler fluid passes as the fluids pass between their respective inlets and outlets.

For example, the first fluid can have a first temperature at the first fluid inlet manifold 12 and the second fluid can have a second temperature at the second fluid inlet manifold 14. The first temperature (e.g. a particular temperature or range of temperatures) can be hotter than the second temperature of the second fluid (e.g. a particular temperature or range of temperatures of the second fluid is lower than the temperature or range of temperatures of the first fluid). After passing through the heat exchangers 11, the first fluid in the first fluid outlet manifold 15 can have a temperature that is less than its original first temperature or change in phase to a lower energy phase (e.g. transition from a gas phase to a liquid phase). After passing through the heat exchangers 11, the second fluid in the second fluid outlet manifold 13 can have a temperature that is greater than its original second temperature and/or transition to a higher energy phase (e.g. transition from a liquid phase to a gas phase).

As another example, for embodiments where the first fluid is cooler than the second fluid, the first fluid can have a first temperature at the first fluid inlet manifold 12 and the second fluid can have a second temperature at the second fluid inlet manifold 14. The first temperature (e.g. a particular temperature or range of temperatures) can be cooler than the second temperature of the second fluid (e.g. a particular temperature or range of temperatures of the second fluid is higher than the temperature or range of temperatures of the first fluid). After passing through the heat exchangers 11, the first fluid in the first fluid outlet manifold 15 will often have a temperature that is greater than its original first temperature (e.g. temperature of the first fluid in the first fluid inlet manifold 12) and/or will have changed phases to a higher energy phase (e.g. changed from a liquid phase to a gas phase). After passing through the heat exchangers 11, the second fluid in the second fluid outlet manifold 13 will have a temperature that is less than its original second temperature (e.g. temperature of the second fluid in the second fluid inlet manifold 14) and/or will have changed phases (e.g. from a gas phase to a liquid phase).

The first fluid and second fluid may be separated into different portions so that each portion passes through a different respective heat exchanger of the array of heat exchangers 11. For instance, there may be a first portion of first fluid passed through the first heat exchanger 11*a* and a first portion of second fluid passed through the first heat exchanger and a second portion of the first fluid that is passed through the fifth heat exchanger 11*e* and a second portion of second fluid that is passed through the fifth heat exchanger. As another example, there may be a first portion of first fluid and a first portion of second fluid passed through the first heat exchanger 11*a*, a second portion of first fluid and a second portion of second fluid passed through the second heat exchanger 11*b*, a third portion of first fluid and a third portion of second fluid passed through the third heat exchanger 11*c*, a fourth portion of first fluid and a fourth portion of second fluid passed through the fourth heat exchanger 11*d*, and a fifth portion of first fluid and a fifth portion of second fluid passed through the fifth heat exchanger 11*e*.

As can be appreciated from FIGS. 2-12, the manifolds of the heat exchanger apparatus 3 can be arranged and configured to facilitate design flexibility by permitting a combination of U-shape or C-shape manifold configurations with Z-shape or S-shape manifold configurations. Each heat exchanger apparatus 3 can therefore include a combination of (a) U-shape or C-shape flow patterns U for the first and second fluids passed through the heat exchangers 11 with (b) Z-shape and/or S-shape flow patterns Z of the first and second fluids. It should be appreciated that there can be at least one U-shape or C-shape flow pattern U combined with at least one Z-shape or S-shape flow pattern Z in the heat exchanger apparatus 3.

Figure 2:
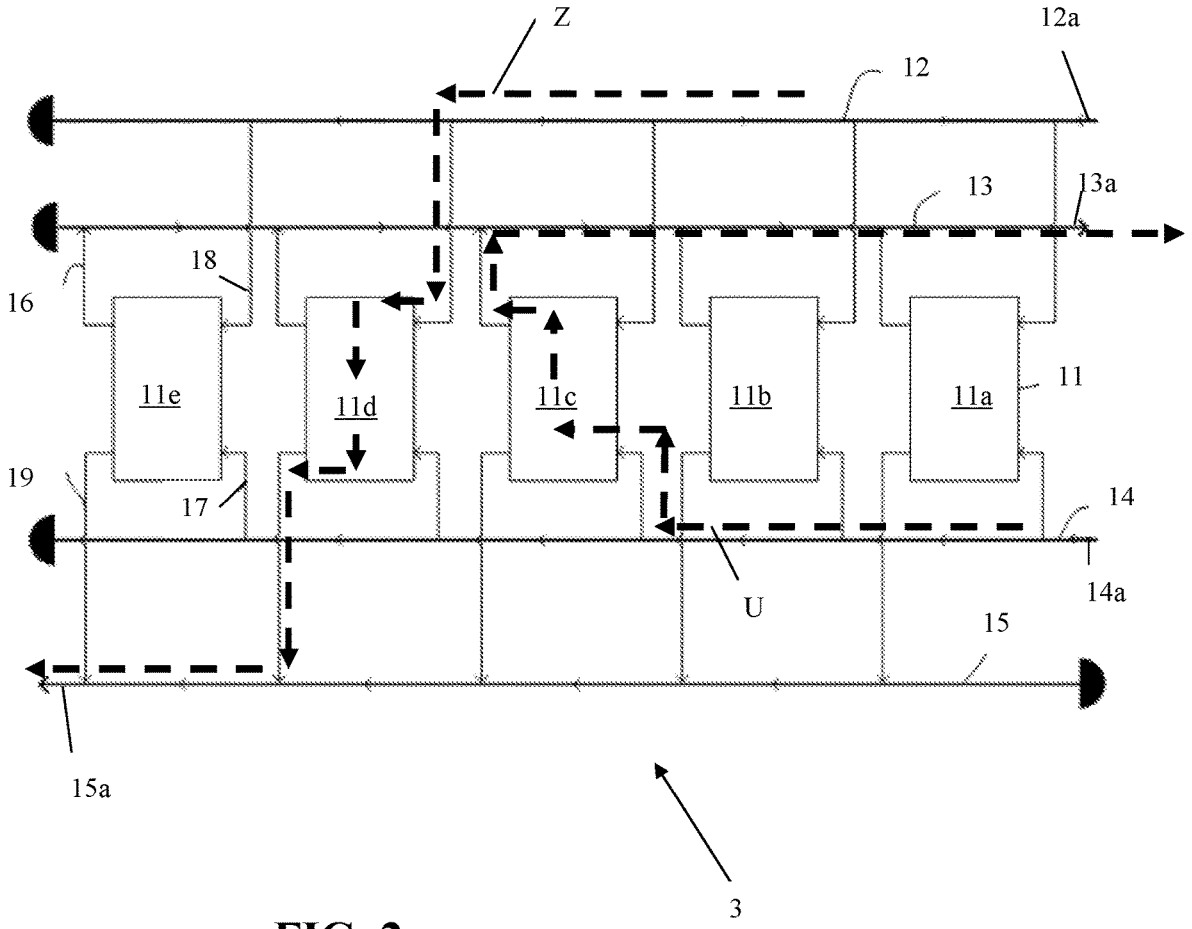
FIG. 2 is a schematic diagram of a first exemplary embodiment of a heat exchanger apparatus that can be included in the exemplary plant shown in FIG. 1. An exemplary U-shaped or C-shaped flow pattern U and an exemplary Z-shaped or S-shaped flow pattern Z are shown in broken line in FIG. 2.

For example, FIG. 2 illustrates an arrangement in which the first fluid inlet 12*a* and second fluid inlet 14*a* are positioned at a same side of the apparatus (e.g. the right side) and the first fluid outlet 15*a* and second fluid outlet 13*a* are on opposite sides of the apparatus (left side for the first fluid outlet 15*a* and right side for the second fluid outlet 14*a*). This arrangement is configured so that the second fluid flow is passed through the heat exchangers 11 in a C-shape or U-shape flow pattern U as the second fluid is moved from the second fluid inlet manifold 14 to the second fluid outlet manifold 13. This arrangement is also configured so that the first fluid flows so it is passed through the heat exchangers 11 in a Z-shape or S-shape flow pattern Z as the first fluid flows between the first fluid inlet manifold 12 and the first fluid outlet manifold 15.

Figure 3:
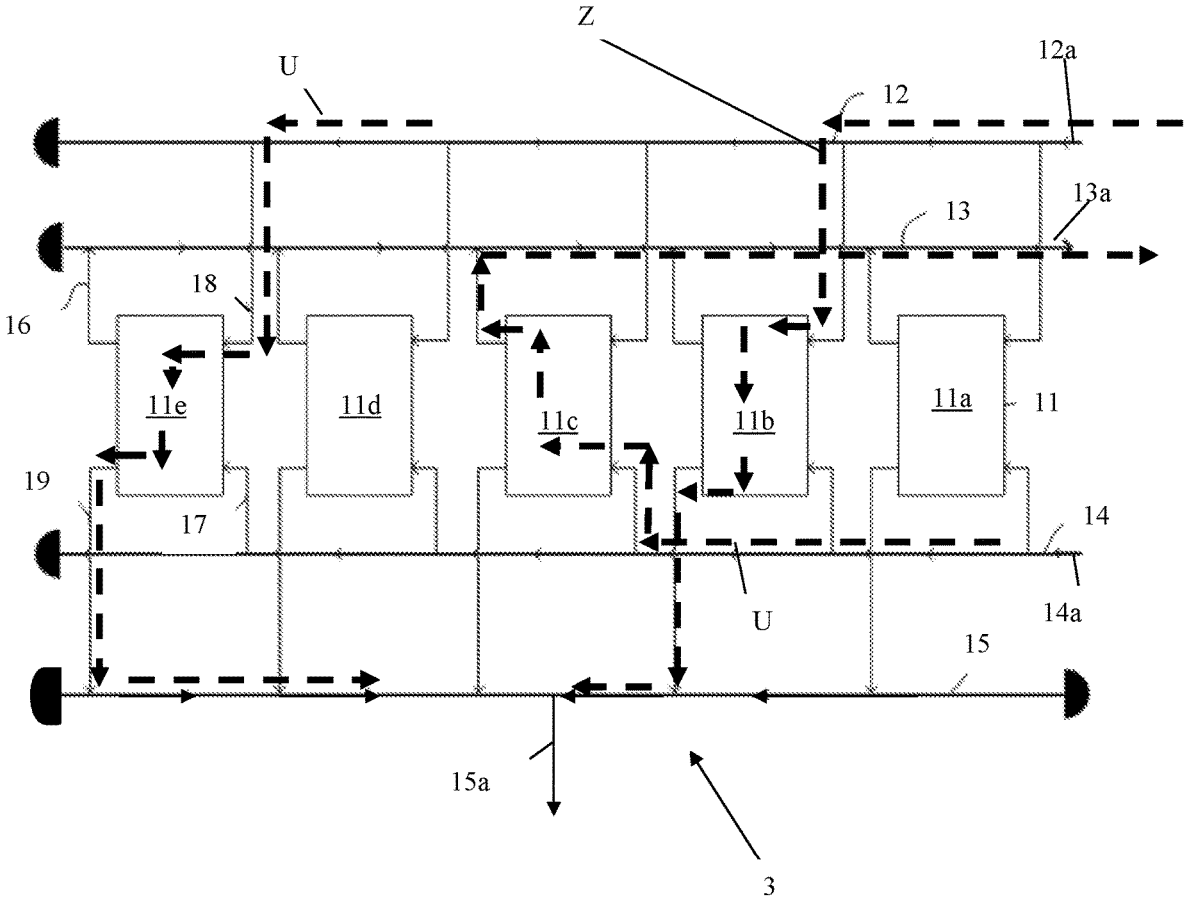
FIG. 3 is a schematic diagram of a second exemplary embodiment of a heat exchanger apparatus that can be included in the exemplary plant shown in FIG. 1. Exemplary U-shaped or C-shaped flow patterns U and an exemplary Z-shaped or S-shaped flow pattern Z are shown in broken line in FIG. 3.

The combination of Z-shape or S-shape flow patterns Z and C-shape or U-shape flow patterns U can also (or alternatively) also involve different combinations of first and second fluid flows so that some second fluid flows and/or some first fluid flows in each of these flow patterns. For instance, the embodiment of FIG. 3 illustrates an arrangement similar to the arrangement shown in FIG. 2 except that the first fluid outlet 15*a* of the first fluid outlet manifold 15 is positioned in a middle or central position between the left and right sides of the apparatus (as compared to a left side of the apparatus as shown in FIG. 2). For the embodiment of FIG. 3, the flow patterns for the second fluid is the same as in FIG. 2—the second fluid flow is passed through the heat exchangers 11 in a C-shape or U-shape flow pattern U as the second fluid is moved from the second fluid inlet manifold 14 to the second fluid outlet manifold 13. But, in the embodiment of FIG. 3, the flow pattern for some of the first fluid flows is different. The first portion of the first fluid passed through the first heat exchanger 11*a* and the second portion of the first fluid passed through the second heat exchanger 11*b* flow in a Z-shape or S-shape pattern. The third, fourth, and fifth portions of the first fluid passed through the third heat exchanger 11*c*, fourth heat exchanger 11*d*, and fifth heat exchanger 11*e* flow in a C-shape or U-shape pattern. The first fluid manifold arrangement therefore is configured to include both C-shape (or U-shape) manifold flow pattern conduit segments as well as Z-shape (or S-shape) manifold flow pattern conduit segments for the first fluid passed through the heat exchanger apparatus 3.

Figure 4:
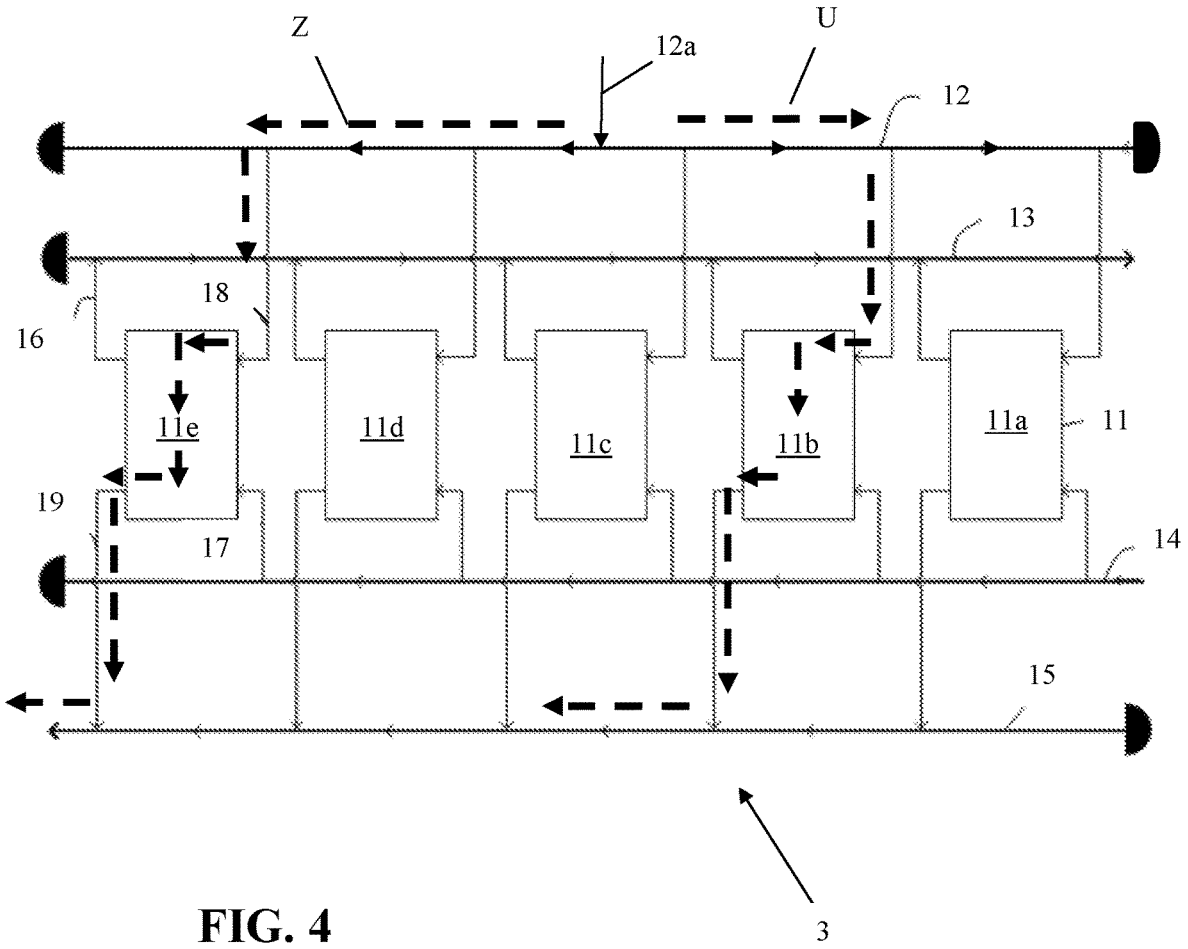
FIG. 4 is a schematic diagram of a third exemplary embodiment of a heat exchanger apparatus that can be included in the exemplary plant shown in FIG. 1. An exemplary U-shaped or C-shaped flow pattern U and an exemplary Z-shaped or S-shaped flow pattern Z are shown in broken line in FIG. 4.

As yet another example, the embodiment illustrated in FIG. 4 is similar to the embodiment shown in FIG. 2 except that the first fluid inlet 12*a* of the first fluid inlet manifold 12 is in a more central or middle position as compared to being on a right side of the apparatus. For the embodiment of FIG. 4, the flow patterns for the second fluid is the same as in FIGS. 2 and 3—the second fluid flow is passed through the heat exchangers 11 in a C-shape or U-shape flow pattern as the second fluid is moved from the second fluid inlet manifold 14 to the second fluid outlet manifold 13. But, in the embodiment of FIG. 4, the flow pattern for some of the first fluid flows is different as compared to the embodiment shown in FIGS. 2 and 3. The first, second, and third portions of the first fluid passed through the first heat exchanger 11*a*, second heat exchanger 11*b*, and the third heat exchanger 11*c* flow in a C-shape or U-shape pattern. The fourth portion and fifth portion of the first fluid passed through the fourth heat exchanger 11*d* and fifth heat exchanger 11*e* flow in a Z-shape or S-shape pattern. The first fluid manifold arrangement therefore is configured to include both C-shape (or U-shape) manifold flow pattern conduit segments as well as Z-shape (or S-shape) manifold flow pattern conduit segments for the first fluid passed through the heat exchanger apparatus 3.

Figure 5:
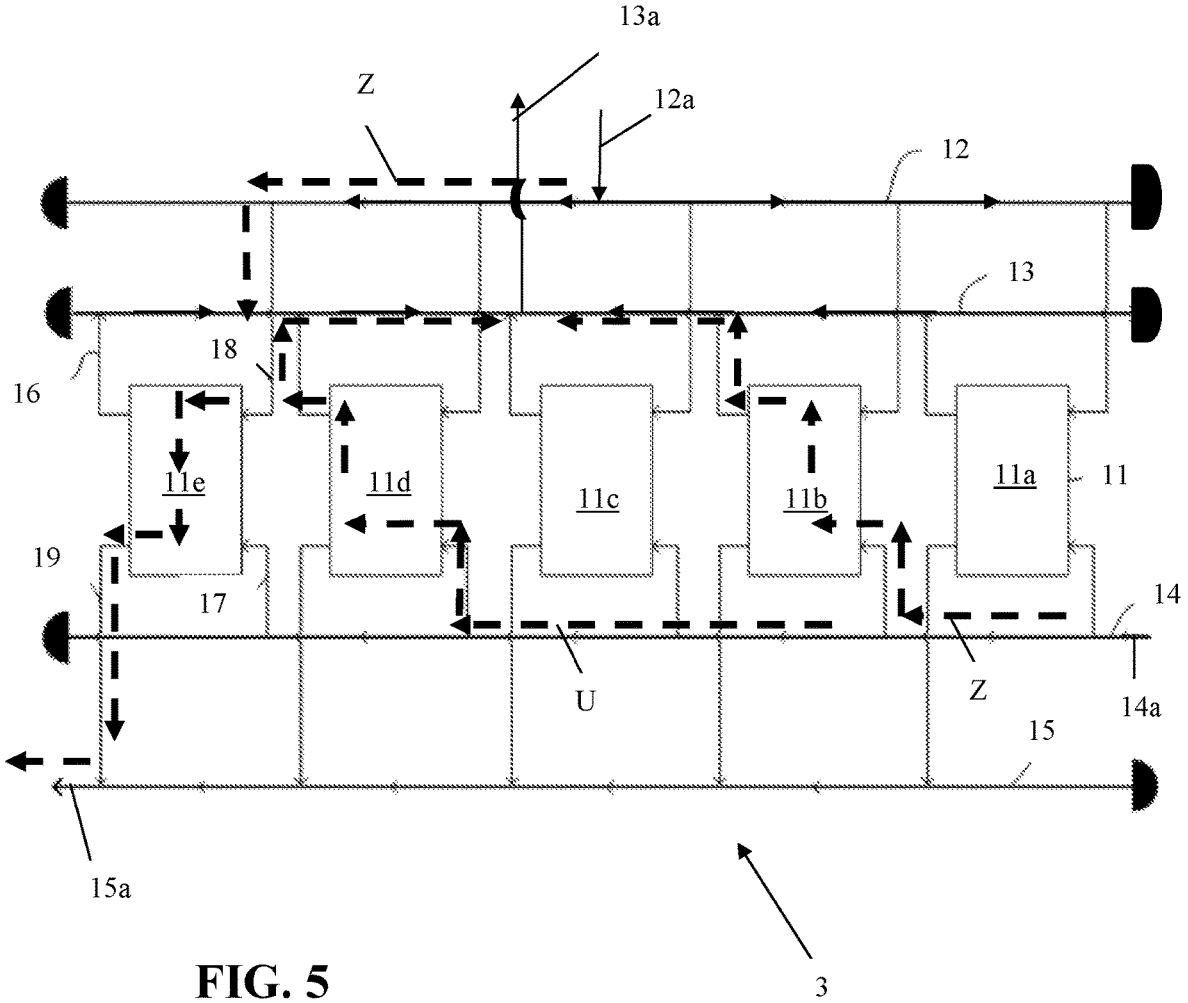
FIG. 5 is a schematic diagram of a fourth exemplary embodiment of a heat exchanger apparatus that can be included in the exemplary plant shown in FIG. 1. An exemplary U-shaped or C-shaped flow pattern U and exemplary Z-shaped or S-shaped flow patterns Z are shown in broken line in FIG. 5.

The embodiment shown in FIG. 5 illustrates yet another arrangement that further illustrates the design and fabrication flexibility embodiments of the heat exchanger apparatus 3 can provide. The embodiment of FIG. 5 is similar in arrangement to the embodiment shown in FIG. 2 except that the first fluid inlet 12*a* and the second fluid outlet 13*a* are positioned at middle or central positions instead of at a right side of the heat exchanger apparatus 3. The flow patterns for both the first fluid and the second fluid in the embodiment of FIG. 5 each have a combination of C-shape or U-shape flow patterns and Z-shape or S-shape flow patterns.

For example, the flow pattern for the first fluid in the embodiment illustrated in FIG. 5 is the same as the flow pattern of the first fluid for the embodiment of FIG. 4—The first, second, and third portions of the first fluid passed through the first heat exchanger 11*a*, the second heat exchanger 11*b* and the third heat exchanger 11*c* flow in a C-shape or U-shape pattern. The fourth, and fifth portions of the first fluid passed through the fourth heat exchanger 11*d* and fifth heat exchanger 11*e* flow in a Z-shape or S-shape pattern. The first fluid manifold arrangement for the embodiment shown in FIG. 5 therefore is configured to include both C-shape (or U-shape) manifold flow pattern conduit segments as well as Z-shape (or S-shape) manifold flow pattern conduit segments for the first fluid passed through the heat exchanger apparatus 3.

The flow pattern for the second fluid for the embodiment shown in FIG. 5 includes a Z-shape or S-shape pattern for the first portion of the second fluid passed through the first heat exchanger 11*a* and the second portion of the second fluid passed through the second heat exchanger 11*b*. The flow pattern for the second fluid is in a C-shape or U-shape pattern for the third portion of the second fluid passed through the third heat exchanger 11*c*, the fourth portion of the second fluid passed through the fourth heat exchanger 11*d*, and the fifth portion of the second fluid passed through the fifth heat exchanger 11*e*. The second fluid manifold arrangement for the embodiment shown in FIG. 5 therefore is configured to include both C-shape (or U-shape) manifold flow pattern conduit segments as well as Z-shape (or S-shape) manifold flow pattern conduit segments for the first fluid passed through the heat exchanger apparatus 3.

Figure 6:
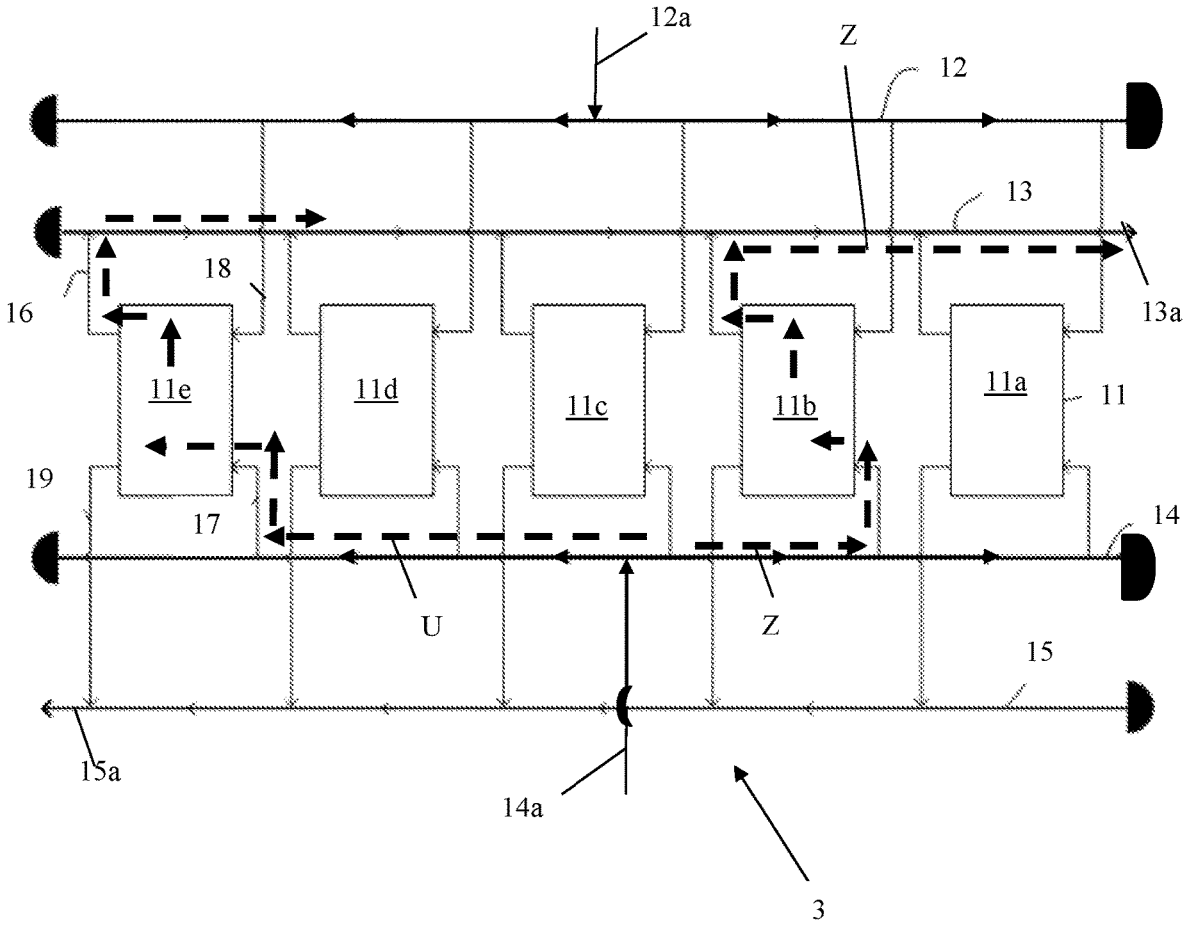
FIG. 6 is a schematic diagram of a fifth exemplary embodiment of a heat exchanger apparatus that can be included in the exemplary plant shown in FIG. 1. An exemplary U-shaped or C-shaped flow pattern U and an exemplary Z-shaped or S-shaped flow pattern Z are shown in broken line in FIG. 6.

The heat exchanger apparatus 3 embodiment shown in FIG. 6 illustrates yet another arrangement that further illustrates the design and fabrication flexibility embodiments of the heat exchanger apparatus 3 can provide. The embodiment of FIG. 6 is similar in arrangement to the embodiment shown in FIG. 5 except that the second fluid outlet 13*a* is positioned at the right side of the apparatus and the second fluid inlet 14*a* is positioned at a middle or central position instead of at a right side of the heat exchanger apparatus 3. The flow patterns for both the first fluid and the second fluid in the embodiment of FIG. 6 each have a combination of C-shape or U-shape flow patterns and Z-shape or S-shape flow patterns.

For example, the flow pattern for the first fluid in the embodiment illustrated in FIG. 6 is the same as the flow pattern of the first fluid for the embodiment of FIG. 5—The first, second, and third portions of the first fluid passed through the first heat exchanger 11*a*, the second heat exchanger 11*b* and the third heat exchanger 11*c* flow in a C-shape or U-shape pattern. The fourth and fifth portions of the first fluid passed through the fourth heat exchanger 11*d* and fifth heat exchanger 11*e* flow in a Z-shape or S-shape pattern. The first fluid manifold arrangement for the embodiment shown in FIG. 5 therefore is configured to include both C-shape (or U-shape) manifold flow pattern conduit segments as well as Z-shape (or S-shape) manifold flow pattern conduit segments for the first fluid passed through the heat exchanger apparatus 3.

The flow pattern for the second fluid for the embodiment shown in FIG. 6 includes a Z-shape or S-shape pattern for the first, second, and third portions of the second fluid passed through the first heat exchanger 11*a*, the second heat exchanger 11*b*, and the third heat exchanger 11*c*. The flow pattern for the second fluid is in a C-shape or U-shape pattern for the fourth portion of the second fluid passed through the fourth heat exchanger 11*d* and the fifth portion of the second fluid passed through the fifth heat exchanger 11*e*. The second fluid manifold arrangement for the embodiment shown in FIG. 6 therefore is configured to include both C-shape (or U-shape) manifold flow pattern conduit segments as well as Z-shape (or S-shape) manifold flow pattern conduit segments for the first fluid passed through the heat exchanger apparatus 3.

Figure 7:
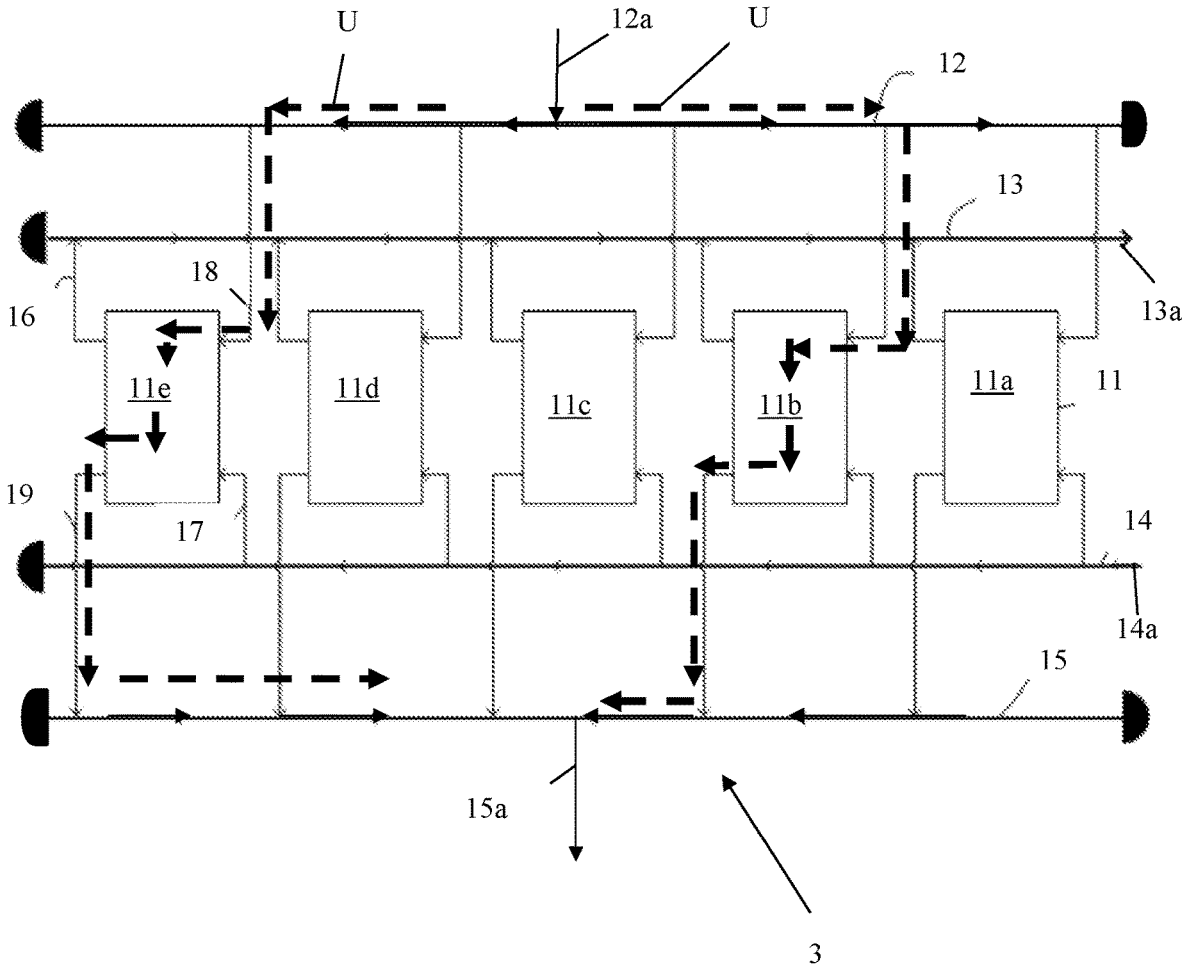
FIG. 7 is a schematic diagram of a sixth exemplary embodiment of a heat exchanger apparatus that can be included in the exemplary plant shown in FIG. 1. Exemplary U-shaped or C-shaped flow patterns are shown in broken line in FIG. 7.

As yet another example, the embodiment illustrated in FIG. 7 is similar to the embodiment shown in FIG. 2 except that the first fluid inlet 12*a* of the first fluid inlet manifold 12 is in a more central or middle position as compared to being on a right side of the apparatus and the first fluid outlet 15*a* of the first fluid outlet manifold 15 is also at a more central or middle position as compared to being on a left side of the apparatus. For the embodiment of FIG. 7, the flow patterns for the second fluid is the same as in FIGS. 2, 3, and 4—the second fluid flow is passed through the heat exchangers 11 in a C-shape or U-shape flow pattern U as the second fluid is moved from the second fluid inlet manifold 14 to the second fluid outlet manifold 13. But, in the embodiment of FIG. 7, the flow pattern for some of the first fluid flows is different as compared to the embodiment shown in FIGS. 2, 3 and 4. The first portion of the first fluid passed through the first heat exchanger 11*a* and the second portion of the first fluid passed through the second heat exchanger 11*b* flow in a U-shape or C-shape flow pattern U. The third portion of the first fluid passed through the third heat exchanger 11*c*, the fourth portion of the first fluid passed through fourth heat exchanger 11*d*, and the fifth portion of the first fluid passed through the fifth heat exchanger 11*e* flow in a C-shape or U-shape flow pattern U. The first fluid manifold arrangement of FIG. 7 includes C-shape (or U-shape) manifold flow pattern conduit segments for the first fluid passed through the heat exchanger apparatus 3.

Figure 8:
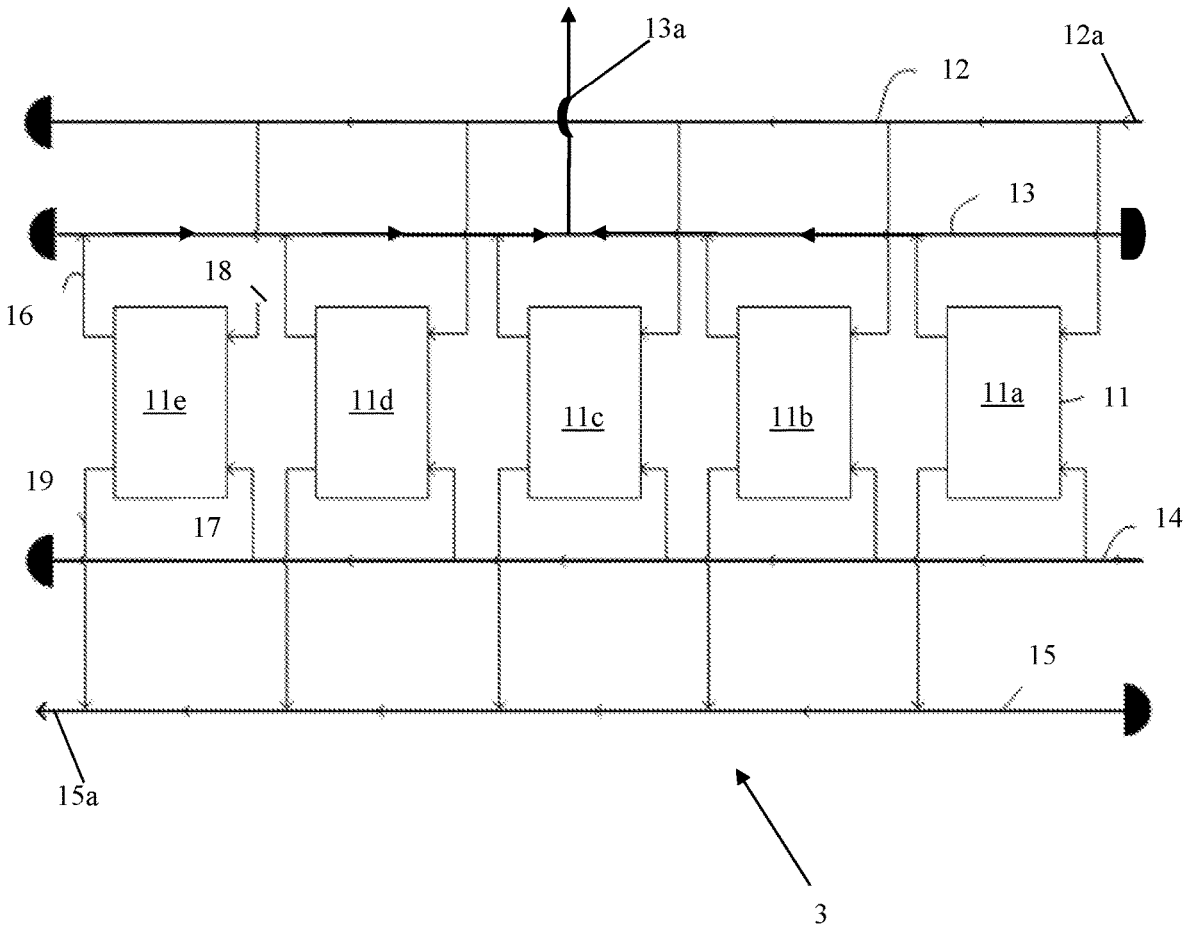
FIG. 8 is a schematic diagram of a seventh exemplary embodiment of a heat exchanger apparatus that can be included in the exemplary plant shown in FIG. 1.

The embodiment illustrated in FIG. 8 is similar to the embodiment shown in FIG. 2 except that the second fluid outlet 13*a* of the second fluid outlet manifold 13 is in a more central or middle position as compared to being on a right side of the apparatus. For the embodiment of FIG. 8, the flow patterns for the first fluid is the same as in FIG. 2—the first fluid flow is passed through the heat exchangers 11 in a Z-shape or S-shape flow pattern Z as the first fluid is moved from the first fluid inlet manifold 12 to the first fluid outlet manifold 15. However, in the embodiment of FIG. 8, the flow pattern for some of the second fluid flows is different as compared to the embodiment shown in FIG. 2. The first and second portions of the second fluid passed through the first heat exchanger 11*a* and the second heat exchanger 11*b* (respectively) flow in a Z-shape or S-shape flow pattern Z. The third portion of the second fluid passed through the third heat exchanger 11*c*, the fourth portion of the second fluid passed through the fourth heat exchanger 11*d*, and the fifth portion of the second fluid passed through the fifth heat exchanger 11e flow in a U-shape or C-shape flow pattern U. The second fluid manifold arrangement therefore is configured to include both C-shape (or U-shape) manifold flow pattern conduit segments as well as Z-shape (or S-shape) manifold flow pattern conduit segments for the first fluid passed through the heat exchanger apparatus 3.

Figure 9:
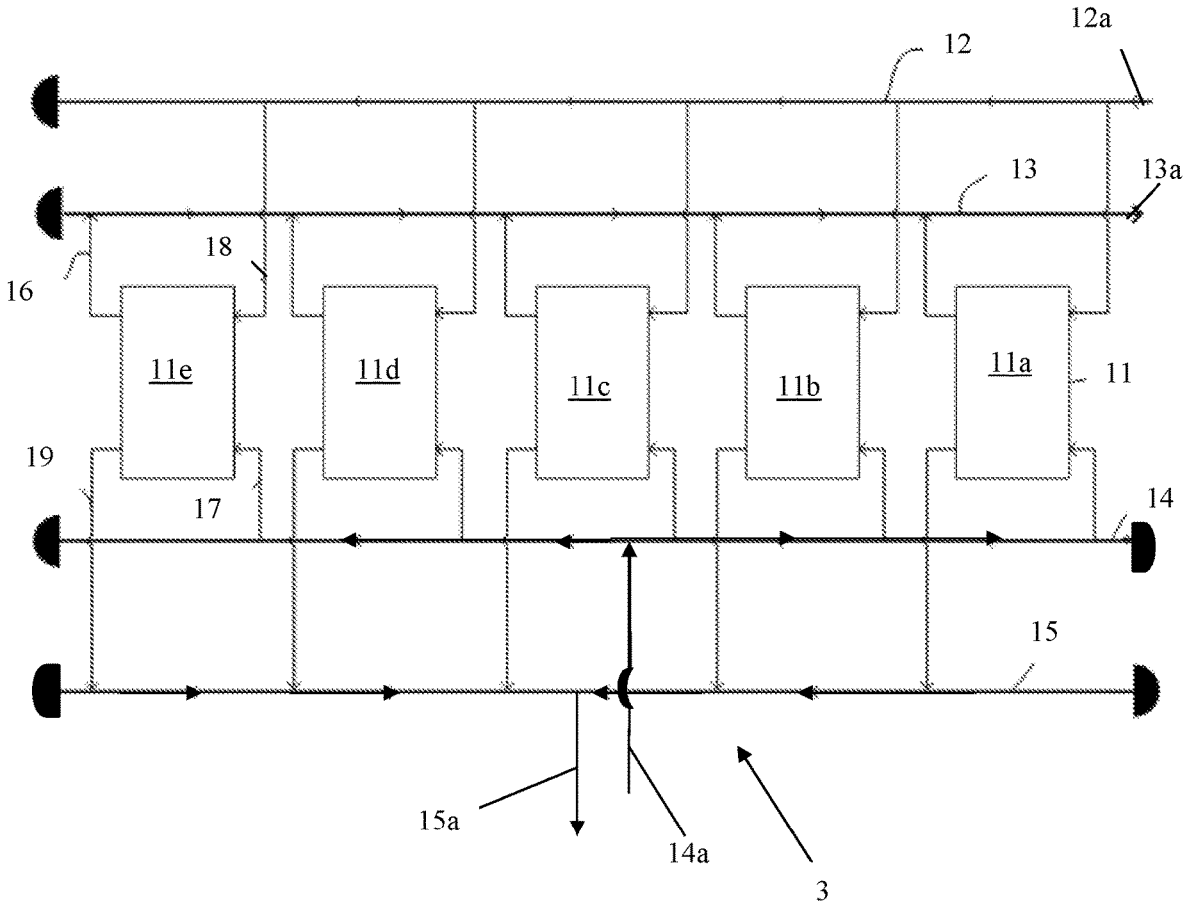
FIG. 9 is a schematic diagram of an eighth exemplary embodiment of a heat exchanger apparatus that can be included in the exemplary plant shown in FIG. 1.

The embodiment illustrated in FIG. 9 is similar to the embodiment shown in FIG. 2 except that the second fluid inlet 14*a* of the second fluid inlet manifold 14 is in a more central or middle position as compared to being on a right side of the apparatus and the first fluid outlet 15*a* of the first fluid outlet manifold 15 is in a more central or middle position as compared to being on the left side of the apparatus. For the embodiment of FIG. 9, the flow patterns for the first fluid includes both C-shaped and U-shaped flow patterns U and Z-shaped or S-shaped flow patterns Z. The first portion of the first fluid flow that is passed through the first heat exchanger 11*a* and the second portion of the first fluid that is passed through the second heat exchanger 11*b* flow in a Z-shape or S-shape flow pattern Z as the first fluid is moved from the first fluid inlet manifold 12 to the first fluid outlet manifold 15. The third portion of the first fluid that flows through the third heat exchanger 11*c*, the fourth portion of the first fluid that is passed through the fourth heat exchanger 11*d*, and the fifth portion of the first fluid that is passed through the fifth heat exchanger 11*e* flow in a C-shaped or U-shaped flow pattern U as the first fluid is moved from the first fluid inlet manifold 12 to the first fluid outlet manifold 15. The first fluid manifold arrangement of FIG. 9 is configured to include both C-shape (or U-shape) manifold flow pattern conduit segments as well as Z-shape (or S-shape) manifold flow pattern conduit segments for the first fluid passed through the heat exchanger apparatus 3.

The flow pattern for some of the second fluid flows in the embodiment of FIG. 9 is also different as compared to the embodiment shown in FIG. 2. The first portion of the second fluid passed through the first heat exchanger 11*a*, the second portion of the second fluid passed through the second heat exchanger 11*b*, and the third portion of the second fluid passed through the third heat exchanger 11*c* flow in a Z-shape or S-shape flow pattern Z. The fourth portion of the second fluid passed through the fourth heat exchanger 11*d* and the fifth portion of the second fluid passed through the fifth heat exchanger 11*e* flow in a U-shape or C-shape pattern U. The second fluid manifold arrangement of FIG. 10 is configured to include both C-shape (or U-shape) manifold flow pattern conduit segments as well as Z-shape (or S-shape) manifold flow pattern conduit segments for the second fluid passed through the heat exchanger apparatus 3.

Figure 10:
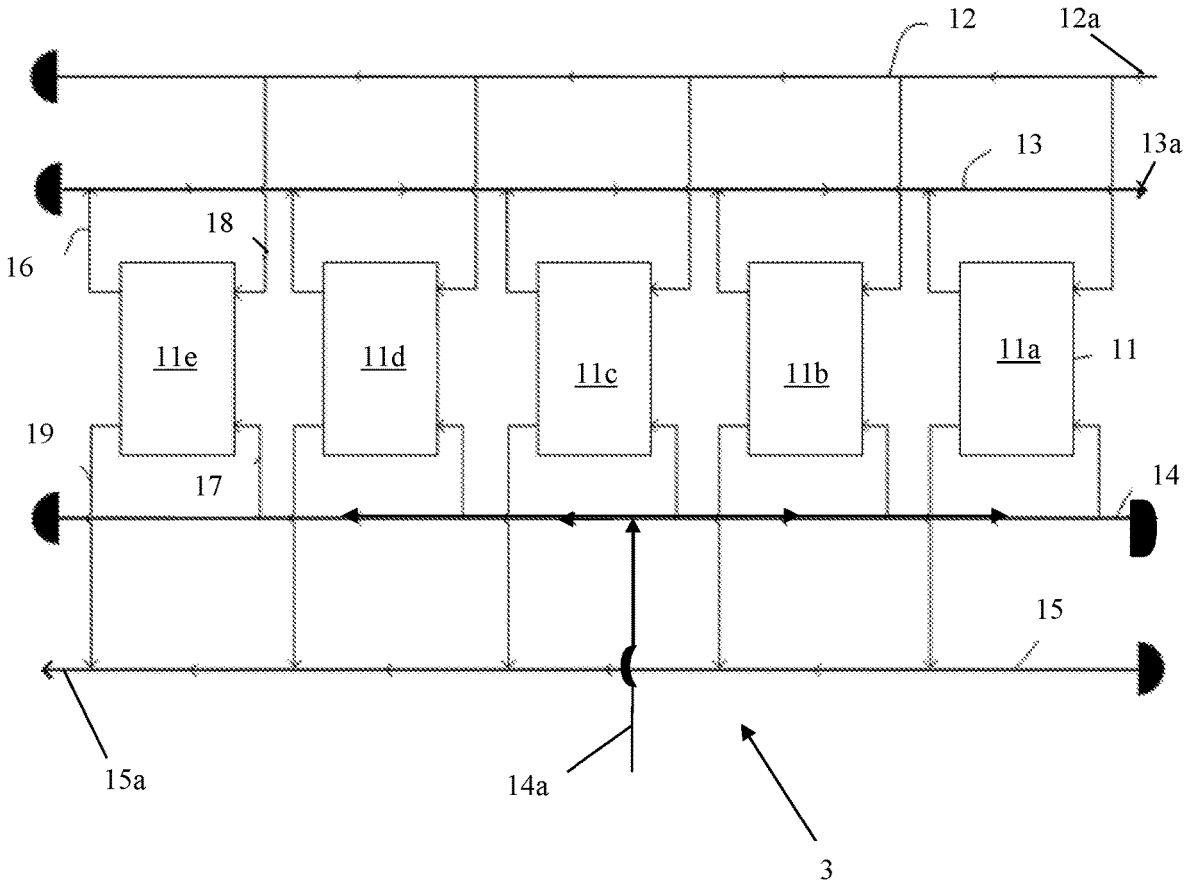
FIG. 10 is a schematic diagram of a ninth exemplary embodiment of a heat exchanger apparatus that can be included in the exemplary plant shown in FIG. 1.

The embodiment illustrated in FIG. 10 is similar to the embodiment shown in FIG. 2 except that the second fluid inlet 14*a* of the second fluid inlet manifold 14 is in a more central or middle position as compared to being on a right side of the apparatus. For the embodiment of FIG. 10, the flow patterns for the first fluid is the same as in FIG. 2—the first fluid flow is passed through the heat exchangers 11 in a Z-shape or S-shape flow pattern Z as the first fluid is moved from the first fluid inlet manifold 12 to the first fluid outlet manifold 15. But, in the embodiment of FIG. 10, the flow pattern for some of the second fluid flows is different as compared to the embodiment shown in FIG. 2. The first portion of the second fluid passed through the first heat exchanger 11*a*, the second portion of the second fluid passed through the second heat exchanger 11*b*, and the third portion of the second fluid passed through the third heat exchanger 11*c* flow in a Z-shape or S-shape flow pattern Z. The fourth portion of the second fluid passed through the fourth heat exchanger 11*d* and the fifth portion of the second fluid passed through the fifth heat exchanger 11*e* flow in a U-shape or C-shape flow pattern U. The second fluid manifold arrangement of FIG. 10 is configured to include both C-shape (or U-shape) manifold flow pattern conduit segments as well as Z-shape (or S-shape) manifold flow pattern conduit segments for the second fluid passed through the heat exchanger apparatus 3.

Figure 11:
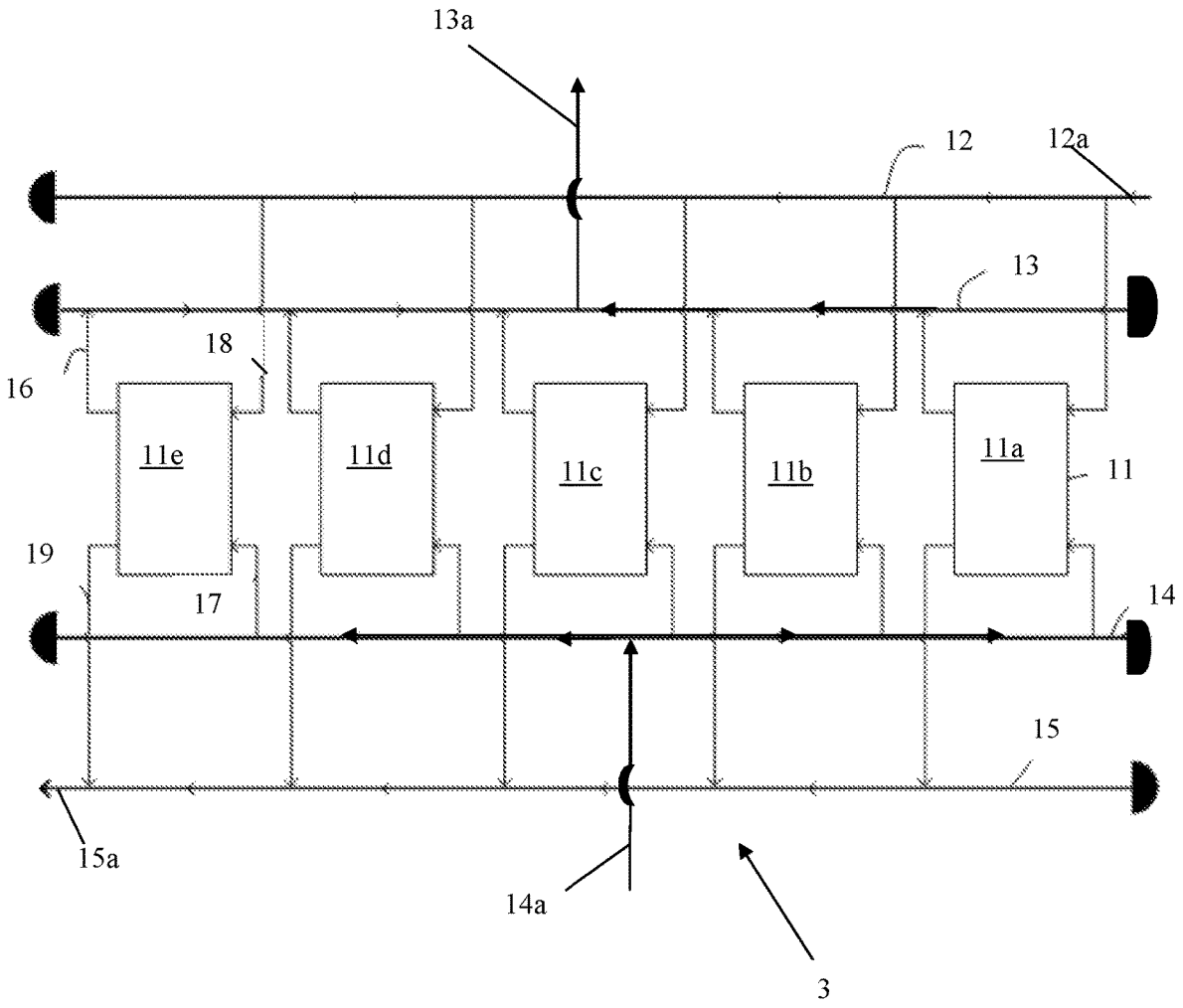
FIG. 11 is a schematic diagram of a tenth exemplary embodiment of a heat exchanger apparatus that can be included in the exemplary plant shown in FIG. 1.

The heat exchanger apparatus 3 embodiment illustrated in FIG. 11 is similar to the embodiment shown in FIG. 2 except that the second fluid inlet 14*a* of the second fluid inlet manifold 14 is in a more central or middle position as compared to being on a right side of the apparatus and the second fluid outlet 13*a* of the second fluid outlet manifold is also in a more central or middle position as compared to being on the right side of the apparatus. For the embodiment of FIG. 11, the flow patterns for the first fluid is the same as in FIG. 2—the first fluid flow is passed through the heat exchangers 11 in a Z-shape or S-shape flow pattern Z as the first fluid is moved from the first fluid inlet manifold 12 to the first fluid outlet manifold 15. But, in the embodiment of FIG. 11, the flow pattern for some of the second fluid flows is different as compared to the embodiment shown in FIG. 2. The first portion of the second fluid passed through the first heat exchanger 11*a* and the second portion of the second fluid passed through the second heat exchanger 11*b* flow in a U-shape or C-shape flow pattern U. The third portion of the second fluid passed through the third heat exchanger 11*c*, the fourth portion of the second fluid passed through the fourth heat exchanger 11*d* and the fifth portion of the second fluid passed through the fifth heat exchanger 11*e* also flow in a U-shape or C-shape pattern U. The second fluid manifold arrangement of FIG. 11 is configured to include C-shape (or U-shape) manifold flow pattern conduit segments for the second fluid passed through the heat exchanger apparatus 3.

Figure 12:
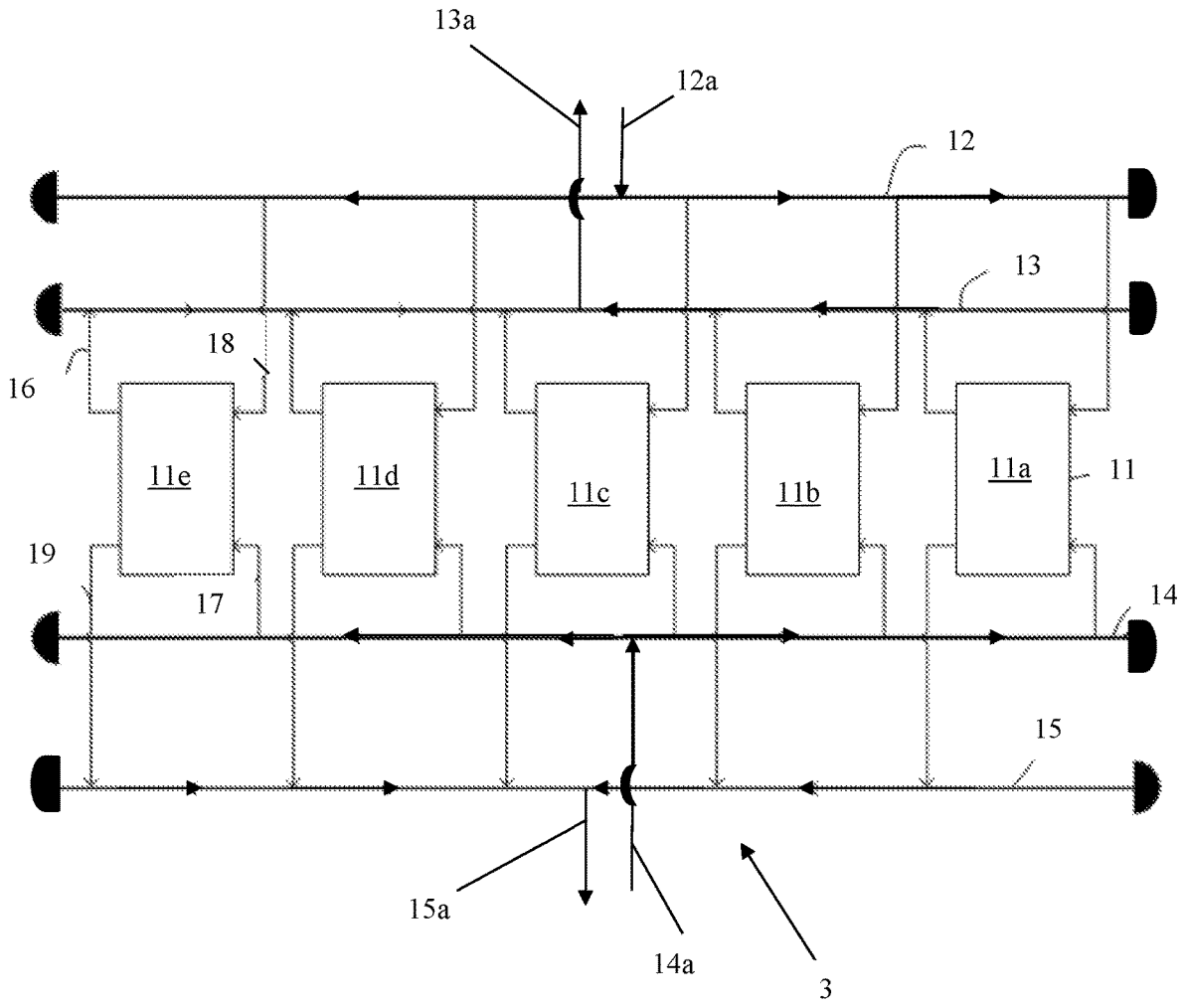
FIG. 12 is a schematic diagram of an eleventh exemplary embodiment of a heat exchanger apparatus that can be included in the exemplary plant shown in FIG. 1.

The heat exchanger apparatus 3 embodiment illustrated in FIG. 12 is similar to the embodiment shown in FIG. 11 except that the first fluid inlet 12*a* of the first fluid inlet manifold 12 is in a more central or middle position as compared to being on a right side of the apparatus and the first fluid outlet 15*a* of the first fluid outlet manifold 15 is also in a more central or middle position as compared to being on the left side of the apparatus. For the embodiment of FIG. 12, the flow patterns for the second fluid is the same as in FIG. 11—the second fluid flow is passed through the heat exchangers 11 in a U-shape or C-shape flow pattern U. As in FIG. 11, the second fluid manifold arrangement of FIG. 12 is configured to include C-shape (or U-shape) manifold flow pattern conduit segments for the second fluid passed through the heat exchanger apparatus 3.

In the embodiment of FIG. 12, the flow pattern for some of the first fluid flows is different as compared to the embodiment shown in FIG. 2. The flow pattern of the first fluid for the embodiment of FIG. 12 is, instead, similar to the flow pattern for the embodiment shown in FIG. 7. The first portion of the first fluid is passed through the first heat exchanger 11*a* and the second portion of the first fluid is passed through the second heat exchanger 11*b* in a U-shape or C-shape flow pattern U. The third portion of the first fluid passed through the third heat exchanger 11*c*, the fourth portion of the first fluid passed through the fourth heat exchanger 11*d* and the fifth portion of the first fluid that is passed through the fifth heat exchanger 11*e* flow in a U-shape or C-shape flow pattern U. The first fluid manifold arrangement of FIG. 12 is configured to include C-shape (or U-shape) manifold flow pattern conduit segments for the first fluid passed through the heat exchanger apparatus 3.

It should be appreciated that FIGS. 2-12 illustrate a first fluid manifold arrangement and a second fluid manifold arrangement. There may be multiple first fluid manifolds and also multiple second fluid manifolds. For instance, there may be more than one warmer fluid manifold in a particular apparatus. In some embodiments, there may be two manifolds for warmer fluid flows, for example. There may also be more than one cooler fluid manifolds. For example, there may be two, four, five, or seven cooler fluid manifolds. Each warmer fluid manifold and cooler fluid manifold can be configured for transport of a particular type of fluid (e.g. nitrogen fluid flow, oxygen fluid flow, air flow, carbon dioxide fluid flow, etc.).

The heat exchangers 11 can be configured as multiple stream heat exchangers. For instance, the heat exchangers 11 can be configured as multiple stream heat exchangers when there are multiple fluid manifolds for cooler and/or warmer fluids. The multiple warmer fluids can be passed form their respective manifolds to the heat exchangers via respective inlet feeds for transferring heat to multiple cooler fluids passed from their respective manifolds into the heat exchanges 11 via respective inlet feeds in such embodiments.

To reach even flow distribution, U-shape (or C-shape) manifolds are often much smaller than Z-shape (or S-shape) manifolds for low-pressure streams. For high pressure streams, U-shape (or C-shape) manifolds are typically slightly smaller than Z-shape (or S-shape) manifolds. To help minimize the cost while obtaining an optimal flow distribution, embodiments of the heat exchange apparatus 3 can utilize Z-shape or S-shape manifolds for high-pressure streams and U-shape or C-shape manifolds can be chosen for low-pressure streams.

For example, in high pressure heat exchanger apparatuses 3, most streams are high-pressure streams (e.g. streams having a pressure in the range of 10 bar to 135 bar) and one or more streams (usually one or two) may be low-pressure stream(s) (e.g. streams having a pressure in the range of 0.5 bar to 10 bar that is lower than the pressure of the high pressure streams). The high-pressure streams of the heat exchanger apparatus 3 can have Z-shape manifolds and the low-pressure stream(s) can have U-shape manifolds. This combined manifold arrangement can provide flexibility in plant layout, while maintaining low cost of building cold boxes or other types of heat exchanger apparatuses 3. Flexibility is further provided by such options as upstream and/or downstream lines can be connected to manifolds at a center point or an off-center point on the manifolds. The choices of the connecting point can depend on location of the other plant units, the space availability inside the heat exchanger apparatus housing within a plant 1, and other space constraints. In such an arrangement, some heat exchangers having U-shape (or C-shape) manifolds while the other heat exchangers have Z-shape (or C-shape) manifolds can help address such spacing constraints. With such an arrangement, the upstream or downstream lines can enter the heat exchanger apparatus 3 (e.g. a cold box) from all four sides or six sides of the apparatus (e.g. front, back, left, rear, top and bottom or just front, back, left and right sides). This can add a significant amount of flexibility in designing cold boxes and other heat exchanger apparatuses and plant layouts. This type of improved design flexibility can also help ensure a reduction in fabrication and installation costs.

In the manifolds that facilitate use of a U-shape or C-shape flow pattern U, we determined that the pressure in the inlet manifold can increase as the flow proceeds in a flow direction of the fluid as the fluid moves along an inlet manifold. This increase in pressure can be due to the mass loss that occurs due to portions of the fluid being output from an inlet manifold to different heat exchanges (e.g. first portion of a fluid flow passed to first heat exchanger 11*a*, second portion of the fluid flow passed to second heat exchanger 11*b*, third portion of the fluid flow passed to third heat exchanger 11*c*, fourth portion of the fluid flow passed to fourth heat exchanger 11*d*, fifth portion of the fluid flow passed to fifth heat exchanger 11*e*, etc.) as the fluid is passed from the inlet manifold to the outlet of the outlet manifold.

We also determined that the pressure in the outlet manifold for a U-shaped or C-shaped flow pattern U can decrease as the flow of an outlet manifold passes from a heat exchanger farthest from the outlet of the outlet manifold to the outlet of the outlet manifold due to the mass gain from other heat exchangers that may add additional portions of the fluid flow to the outlet manifold.

We determined that when the pressure gain in the inlet manifold and the pressure drop in the outlet manifold of a fluid flow passing through a heat exchanger apparatus 3 are balanced, the flow maldistribution can be minimized. We determined that the pressure change in the inlet and outlet manifolds for each fluid can be a function of inlet and outlet manifold diameter. The pressure gain for the inlet manifold and the pressure drop for the outlet manifold can be balanced by choosing the right inlet and outlet manifold size. The inlet and outlet manifolds therefore can be paired so that the pressure drop of an outlet manifold is matched and balanced by the pressure gain of an inlet manifold.

We determined that a larger manifold arrangement does not always give a lower flow maldistribution. The pressure drop through each heat exchanger 11 includes (i) the pressure drop at the tees which connect the heat exchanger nozzles with the inlet and outlet manifolds, (ii) the pressure drop in the manifold pipes and (iii) the pressure drop in the heat exchanger 11. Each part pressure drop through each heat exchanger can be evaluated so that the inlet and outlet manifold sizes are chosen so that the flow maldistribution can be minimized.

For example, the first fluid inlet manifold 14 and the first fluid outlet manifold 13 for the first fluid can be sized so that the pressure gain in the inlet manifold is balanced by the pressure drop in the outlet manifold and the flow maldistribution in multiple heat exchangers 11 is minimized for when portions of the first fluid are passed from the first fluid inlet manifold 14 to the outlet 13*a* of the first fluid outlet manifold 13. Additionally, the second fluid inlet manifold 12 and the second fluid outlet manifold 15 for the second fluid can be sized so that the pressure gain in the inlet manifold is balanced by the pressure drop in the outlet manifold and the flow maldistribution in multiple heat exchangers 11 is minimized for when portions of the second fluid are passed from the second fluid inlet manifold 12 to the outlet 15*a* of the second fluid outlet manifold 15. Such a methodology for selection of the sizing for U-shape or C-shape flow pattern manifolds can reduce the size of the manifold arrangement of the heat exchange apparatus 3 by 10% to 40%. It is contemplated that this methodology can also be applied to Z-shape or S-shape flow pattern manifolds.

Embodiments of the heat exchanger apparatus 3 and the flexibility provided by such apparatuses can be useful in methods of retrofitting a pre-existing plant. For example, a pre-existing plant may be constrained by available space within the plant for upgrades or changes to the plant. Embodiments of the heat exchanger apparatus 3 can provide a mechanism by which a suitable upgraded or improved set of heat exchangers for the plant can be retrofitted into the plant to replace an older set of pre-existing heat exchangers that still accommodate the spacing constraints of the plant by utilizing as much space as the old heat exchanger arrangement or by requiring less space than the older heat exchanger arrangement being replaced. For instance, embodiments of the heat exchanger apparatus 3 can be configured as a replacement cold box that is to replace an older cold box in a pre-existing plant to reduce the footprint the cold box requires in the plant so that plant operations can be expanded to include other process units. Embodiments of the heat exchanger apparatus 3 can therefore provide improved design flexibility in addition to improved costs for fabrication and installation for both new plant designs as well as for retrofit applications in which a new heat exchanger apparatus may replace an older apparatus or may be installed to help facilitate expansion of a plant's operational capacity within the plant's pre-existing footprint.

In the design and implementation of a retrofit operation or the building of a new plant, the first fluid inlet manifold 14 and the first fluid manifold 13 of the heat exchanger apparatus 3 can be sized so that the pressure gain in the inlet manifold is balanced by the pressure drop in the outlet manifold and the flow maldistribution in multiple heat exchangers 11 is minimized. Additionally, the second fluid inlet manifold 12 and the second fluid outlet manifold 15 of the heat exchanger 3 can be sized so that the pressure gain in the inlet manifold is balanced by the pressure drop in the outlet manifold and the flow maldistribution in multiple heat exchangers 11 is minimized. Such sizing of inlet and outlet manifolds can reduce the overall size requirement for the manifold arrangement of the heat exchange apparatus 3 significantly (e.g. by reducing the size requirement by as much as 10% to 40%).

It should be appreciated that modifications to the embodiments explicitly shown and discussed herein can be made to meet a particular set of design objectives or a particular set of design criteria. For example, embodiments of the heat exchanger apparatus 3 can include more than five heat exchangers or less than five heat exchangers. As yet another example, the flow rate, pressure, and temperature of the first and second fluids passed through the heat exchanger apparatus can vary to account for different plant design configurations and other design criteria. As yet another example, the manifold arrangements of the heat exchanger apparatus can utilize different types of conduits (e.g. pipes, tubing, valves, connectors, etc.). The plant 1 can be configured as an air separation plant or other type of plant in which a heat exchanger apparatus 3 can be utilized. The plant and the heat exchanger apparatus can each be configured to include process control elements positioned and configured to monitor and control operations (e.g. temperature and pressure sensors, flow sensors, an automated process control system having at least one work station that includes a processor, non-transitory memory and at least one transceiver for communications with the sensor elements, valves, and controllers for providing a user interface for an automated process control system that may be run at the work station and/or another computer device of the plant, etc.).

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of the manifolds for heat exchangers, heat exchangers, plants having a heat exchanger apparatus that includes manifolds and a plurality of heat exchangers, and methods of making and using the same have been shown and described above, it is to be distinctly understood that the invention is not limited thereto but may be otherwise variously embodied and practiced within the scope of the following claims.

What is claimed is:

1. A heat exchanger apparatus comprising:

a first fluid inlet manifold connectable to at least one first input stream to receive a first fluid at a first fluid inlet of the first fluid inlet manifold, the first fluid having a first temperature;

a second fluid inlet manifold connectable to at least one second input stream to receive a second fluid at a second fluid inlet of the second fluid inlet manifold, the second fluid having a second temperature that is below the first temperature or above the first temperature;

a second fluid outlet manifold;

a first fluid outlet manifold;

a plurality of heat exchangers, each of the heat exchangers connected to the first fluid inlet manifold, the first fluid outlet manifold, the second fluid inlet manifold, and the second fluid outlet manifold so that the first fluid and the second fluid are passable through the heat exchangers so that heat is transferred between the first fluid and the second fluid so that the first fluid changes in enthalpy and the second fluid changes in enthalpy as the first fluid and the second fluid pass through the heat exchangers;

the first fluid outlet manifold connectable to at least one first output stream to output the first fluid after the first fluid has had a change in enthalpy via the plurality of heat exchangers;

the second fluid outlet manifold connectable to at least one second output stream to output the second fluid after the second fluid has had a change in enthalpy via the plurality of heat exchangers;

wherein:

(a) the first fluid inlet manifold and the first fluid outlet manifold are configured so that the first fluid passes between the first fluid inlet manifold and the first fluid outlet manifold and also through the heat exchangers in a Z-shaped flow pattern or an S-shaped flow pattern and the second fluid inlet manifold and the second fluid outlet manifold are configured so that the second fluid passes between the second fluid inlet manifold and the second fluid outlet manifold and also through the heat exchangers in a C-shaped flow pattern or a U-shaped flow pattern;

(b) the first fluid inlet manifold and the first fluid outlet manifold are configured so that a first portion of the first fluid passes between the first fluid inlet manifold and the first fluid outlet manifold and also through the heat exchangers in a Z-shaped flow pattern or an S-shaped flow pattern and a second portion of the first fluid passes between the first fluid inlet manifold and the first fluid outlet manifold and also through the heat exchangers in a U-shaped flow pattern or a C-shaped flow pattern;

(c) the second fluid inlet manifold and the second fluid outlet manifold are configured so that a first portion of the second fluid passes between the second fluid inlet manifold and the second fluid outlet manifold and also through the heat exchangers in a Z-shaped flow pattern or an S-shaped flow pattern and a second portion of the second fluid passes between the second fluid inlet manifold and the second fluid outlet manifold and also through the heat exchangers in a U-shaped flow pattern or a C-shaped flow pattern;

(d) the first fluid inlet manifold and the first fluid outlet manifold are configured so that a first portion of the first fluid passes between the first fluid inlet manifold and the first fluid outlet manifold and also through the heat exchangers in a U-shaped flow pattern or a C-shaped flow pattern and a second portion of the first fluid passes between the first fluid inlet manifold and the first fluid outlet manifold and also through the heat exchangers in a U-shaped flow pattern or a C-shaped flow pattern; and/or (e) the second fluid inlet manifold and the second fluid outlet manifold are configured so that a first portion of the second fluid passes between the second fluid inlet manifold and the second fluid outlet manifold and also through the heat exchangers in a U-shaped flow pattern or a C-shaped flow pattern and a second portion of the second fluid passes between the second fluid inlet manifold and the second fluid outlet manifold and also through the heat exchangers in a U-shaped flow pattern or a C-shaped flow pattern; and wherein the first fluid inlet is positioned at a central portion of the heat exchanger apparatus.

2. The heat exchanger apparatus of claim 1, wherein first fluid inlet manifold and the first fluid outlet manifold are configured so that the first fluid passes between the first fluid inlet manifold and the first fluid outlet manifold and also through the heat exchangers in a Z-shaped flow pattern or an S-shaped flow pattern and the second fluid inlet manifold and the second fluid outlet manifold are configured so that the second fluid passes between the second fluid inlet manifold and the second fluid outlet manifold and also through the heat exchangers in a C-shaped flow pattern or a U-shaped flow pattern.

3. The heat exchanger apparatus of claim 1, wherein the first fluid inlet manifold and the first fluid outlet manifold are configured so that the first portion of the first fluid passes between the first fluid inlet manifold and the first fluid outlet manifold and also through the heat exchangers in a Z-shaped flow pattern or an S-shaped flow pattern and the second portion of the first fluid passes between the first fluid inlet manifold and the first fluid outlet manifold and also through the heat exchangers in a U-shaped flow pattern or a C-shaped flow pattern.

4. The heat exchanger apparatus of claim 1, wherein the second fluid inlet manifold and the second fluid outlet manifold are configured so that the first portion of the second fluid passes between the second fluid inlet manifold and the second fluid outlet manifold and also through the heat exchangers in a Z-shaped flow pattern or an S-shaped flow pattern and the second portion of the second fluid passes between the second fluid inlet manifold and the second fluid outlet manifold and also through the heat exchangers in a U-shaped flow pattern or a C-shaped flow pattern.

5. The heat exchanger apparatus of claim 4, wherein the first fluid inlet manifold and the first fluid outlet manifold are configured so that the first portion of the first fluid passes between the first fluid inlet manifold and the first fluid outlet manifold and also through the heat exchangers in a Z-shaped flow pattern or an S-shaped flow pattern and the second portion of the first fluid passes between the first fluid inlet manifold and the first fluid outlet manifold and also through the heat exchangers in a U-shaped flow pattern or a C-shaped flow pattern.

6. The heat exchanger apparatus of claim 1, wherein the second fluid inlet is positioned at a central portion of the heat exchanger apparatus located between a left side of the heat exchanger apparatus and a right side of the heat exchanger apparatus.

7. The heat exchanger apparatus of claim 1, wherein the second fluid inlet is positioned at a right side or a left side of the heat exchanger apparatus.

8. The heat exchanger apparatus of claim 1, wherein the first fluid outlet manifold has a first fluid outlet that is connectable to the at least one first output stream, the first fluid outlet being positioned at a right side or a left side of the heat exchanger apparatus.

9. The heat exchanger apparatus of claim 1, wherein the first fluid outlet manifold has a first fluid outlet that is connectable to the at least one first output stream, the first fluid outlet being positioned at a central position of the heat exchanger apparatus between a left side of the heat exchanger apparatus and a right side of the heat exchanger apparatus.

10. The heat exchanger apparatus of claim 1, wherein the second fluid outlet manifold has a second fluid outlet that is connectable to the at least one second output stream, the second fluid outlet being positioned at a right side or a left side of the heat exchanger apparatus.

11. The heat exchanger apparatus of claim 1, wherein the second fluid outlet manifold has a second fluid outlet that is connectable to the at least one second output stream, the second fluid outlet being positioned at a central position of the heat exchanger apparatus between a left side of the heat exchanger apparatus and a right side of the heat exchanger apparatus.

12. A heat exchanger apparatus comprising:

a first fluid inlet manifold connectable to at least one first input stream to receive a first fluid at a first fluid inlet of the first fluid inlet manifold, the first fluid having a first temperature;

a second fluid inlet manifold connectable to at least one second input stream to receive a second fluid at a second fluid inlet of the second fluid inlet manifold, the second fluid having a second temperature that is below the first temperature or above the first temperature;

a second fluid outlet manifold;

a first fluid outlet manifold;

a plurality of heat exchangers, each of the heat exchangers connected to the first fluid inlet manifold, the first fluid outlet manifold, the second fluid inlet manifold, and the second fluid outlet manifold so that the first fluid and the second fluid are passable through the heat exchangers so that heat is transferred between the first fluid and the second fluid so that the first fluid changes in enthalpy and the second fluid changes in enthalpy as the first fluid and the second fluid pass through the heat exchangers;

the first fluid outlet manifold connectable to at least one first output stream to output the first fluid after the first fluid has had a change in enthalpy via the plurality of heat exchangers;

the second fluid outlet manifold connectable to at least one second output stream to output the second fluid after the second fluid has had a change in enthalpy via the plurality of heat exchangers;

wherein:

(a) the first fluid inlet manifold and the first fluid outlet manifold are configured so that the first fluid passes between the first fluid inlet manifold and the first fluid outlet manifold and also through the heat exchangers in a Z-shaped flow pattern or an S-shaped flow pattern and the second fluid inlet manifold and the second fluid outlet manifold are configured so that the second fluid passes between the second fluid inlet manifold and the second fluid outlet manifold and also through the heat exchangers in a C-shaped flow pattern or a U-shaped flow pattern;

(b) the first fluid inlet manifold and the first fluid outlet manifold are configured so that a first portion of the first fluid passes between the first fluid inlet manifold and the first fluid outlet manifold and also through the heat exchangers in a Z-shaped flow pattern or an S-shaped flow pattern and a second portion of the first fluid passes between the first fluid inlet manifold and the first fluid outlet manifold and also through the heat exchangers in a U-shaped flow pattern or a C-shaped flow pattern;

(c) the second fluid inlet manifold and the second fluid outlet manifold are configured so that a first portion of the second fluid passes between the second fluid inlet manifold and the second fluid outlet manifold and also through the heat exchangers in a Z-shaped flow pattern or an S-shaped flow pattern and a second portion of the second fluid passes between the second fluid inlet manifold and the second fluid outlet manifold and also through the heat exchangers in a U-shaped flow pattern or a C-shaped flow pattern;

(d) the first fluid inlet manifold and the first fluid outlet manifold are configured so that a first portion of the first fluid passes between the first fluid inlet manifold and the first fluid outlet manifold and also through the heat exchangers in a U-shaped flow pattern or a C-shaped flow pattern and a second portion of the first fluid passes between the first fluid inlet manifold and the first fluid outlet manifold and also through the heat exchangers in a U-shaped flow pattern or a C-shaped flow pattern; and/or (e) the second fluid inlet manifold and the second fluid outlet manifold are configured so that a first portion of the second fluid passes between the second fluid inlet manifold and the second fluid outlet manifold and also through the heat exchangers in a U-shaped flow pattern or a C-shaped flow pattern and a second portion of the second fluid passes between the second fluid inlet manifold and the second fluid outlet manifold and also through the heat exchangers in a U-shaped flow pattern or a C-shaped flow pattern; and wherein the first fluid outlet manifold has a first fluid outlet that is connectable to the at least one first output stream, the first fluid outlet being positioned at a central position of the heat exchanger apparatus between a left side of the heat exchanger apparatus and a right side of the heat exchanger apparatus.

13. The heat exchanger apparatus of claim 12, wherein the first fluid inlet is at a left side of the heat exchanger apparatus or a right side of the heat exchanger apparatus.

14. The heat exchanger apparatus of claim 13, wherein the second fluid inlet is positioned at a right side or a left side of the heat exchanger apparatus.

15. The heat exchanger apparatus of claim 12, wherein the second fluid outlet manifold has a second fluid outlet that is connectable to the at least one second output stream, the second fluid outlet being positioned at a right side or a left side of the heat exchanger apparatus.

16. The heat exchanger apparatus of claim 15, wherein the second fluid inlet is positioned at a right side or a left side of the heat exchanger apparatus.

17. The heat exchanger apparatus of claim 12, wherein the second fluid outlet manifold has a second fluid outlet that is connectable to the at least one second output stream, the second fluid outlet being positioned at a central position of the heat exchanger apparatus between a left side of the heat exchanger apparatus and a right side of the heat exchanger apparatus.

* * * * *